US006466518B1

(12) United States Patent
Akahane et al.

(10) Patent No.: US 6,466,518 B1
(45) Date of Patent: Oct. 15, 2002

(54) TIME MEASUREMENT DEVICE

(75) Inventors: Hidehiro Akahane, Tatsuno-machi; Kenichi Okuhara, Kiso-mura; Akihiko Maruyama, Suwa; Nobuhiro Koike, Chino, all of (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/446,376

(22) PCT Filed: Apr. 21, 1999

(86) PCT No.: PCT/JP99/02135

§ 371 (c)(1),
(2), (4) Date: Feb. 28, 2000

(87) PCT Pub. No.: WO99/54792

PCT Pub. Date: Oct. 28, 1999

(30) Foreign Application Priority Data

Apr. 21, 1998 (JP) ..... 10-111065

(51) Int. Cl.[7] ..... G04B 9/00; G04B 1/00; G04C 3/00; G04F 10/00; G04F 8/00

(52) U.S. Cl. ..... 368/64; 368/66; 368/110; 368/112; 368/113; 368/204

(58) Field of Search ..... 368/64, 203–204, 368/110–113

(56) References Cited

U.S. PATENT DOCUMENTS 4,364,669 A * 12/1982 Thoenig et al. ..... 368/111
4,623,261 A * 11/1986 Muto ..... 368/80
5,740,132 A 4/1998 Oshima et al.
5,889,736 A * 3/1999 Fujita et al. ..... 368/66

FOREIGN PATENT DOCUMENTS

| | | |
|---|---|---|
| JP | 48-25156 | 7/1973 |
| JP | 50-61890 | 10/1973 |
| JP | 49-123366 | 11/1974 |
| JP | 50-9464 | 1/1975 |
| JP | 55-172895 | 5/1979 |
| JP | 56-2583 | 1/1981 |
| JP | 56-108990 | 8/1981 |
| JP | 58-196481 | 11/1983 |
| JP | 59-13973 | 1/1984 |
| JP | 62-47575 | 3/1987 |
| JP | 62-69190 | 3/1987 |
| JP | 5-80165 | 4/1993 |
| JP | 5-215868 | 8/1993 |
| JP | 6-265646 | 9/1994 |
| JP | 7-78543 | 8/1995 |
| JP | 7-306275 | 11/1995 |
| JP | 7-333364 | 12/1995 |
| JP | 9-101380 | 4/1997 |
| JP | 9-274526 | 10/1997 |

* cited by examiner

*Primary Examiner*—Vit Miska

(57) ABSTRACT

A time measurement device includes a first motor (1300) for indicating standard time, a second motor (1400) for indicating a chronograph, a generator (1600) which generates driving power for driving the first and second motors by converting mechanical energy into electrical energy, and a zero reset mechanism (1200) for mechanically resetting the chronograph to zero. A compact time measurement device, operable from a low power, is thus provided.

12 Claims, 20 Drawing Sheets

TIME MEASUREMENT DEVICE

BACKGROUND OF THE INVENTION

1. Field of the Invention

The present invention relates to a multi-function time measurement device having hands.

2. Description of the Related Art

Conventionally available as a multi-function time measurement device having hands is an electronic watch having an analog indicator chronograph function, for example.

Such an electronic watch has, for chronograph purposes, a chronograph hour hand, a chronograph minute hand, and a chronograph second hand, starts time measurement at the pressing of a start/stop button, causing the chronograph hour hand, the chronograph minute hand, and the chronograph second hand to turn. When the start/stop button is pressed again, the electronic watch stops time measurement, thereby stopping the chronograph hour hand, the chronograph minute hand, and the chronograph second hand and indicating a measured time. With a reset button on the electronic watch pressed, the measured time is reset, and the chronograph hour hand, the chronograph minute hand, and the chronograph second hand are reset to zero positions (hereinafter referred to as zero reset).

The electronic watch further has a function of automatically stopping the chronograph hour hand, the chronograph minute hand, and the chronograph second hand at a maximum measurement time, for example, at a watch hand start position for the time measurement. With this function, no power is consumed in vain even if the user forgets pressing the start/stop button in time measurement.

The conventional electronic watch having the analog indicator chronograph function includes, in its body, a motor for driving hands for indicating standard time and a motor for driving watch hands for indicating the chronograph. Furthermore, a button battery is included as a driving power source for the motors, etc.

When there is a plurality of watch hands for indicating the chronograph, each hand has its own motor, and the zero resetting of the chronograph depends on the zero resetting speed of each motor, and as a result, an overall zero resetting speed is substantially slowed. Since operating a number of motors consumes a great deal of power, a high capacity battery or a plurality of button batteries are contained. A bulky electronic watch thus results.

Electronic watches, equipped with a generator, as a driving power source, converting mechanical energy into electrical energy, are today available. If such a generator is contained in the electronic watch having the analog indicator chronograph function, the generator requires a large space to meet a large power consumption as described above. The electronic watch becomes bulky and such a system is not yet in practical use.

It is an object of the present invention to provide an electronic watch which is free from the above problem, is compact and is operated from small power.

SUMMARY OF THE INVENTION

A time measurement device of the present invention, includes a first motor for indicating standard time, a second motor for indicating a chronograph, a generator which generates driving power for driving the first and second motors by converting mechanical energy into electrical energy, and a zero reset mechanism for mechanically resetting the chronograph to zero.

In accordance with the present invention, the time measurement device permits the chronograph to measure any elapsed time while indicating standard time. Since the zero resetting of the chronograph is mechanically carried out, a zero resetting operation is instantaneously performed, and a single motor drives a plurality of chronograph hands. Compared with the conventional art that employs a plurality of motors for driving a plurality of hands, power consumption is greatly reduced. With this arrangement, a unit for converting mechanical energy into electrical energy works as a driving power source for the motor, and the generator is thus made compact, and the time measurement device is accordingly made compact.

In a time measurement device of the present invention, the zero reset mechanism includes a zero reset lever for resetting the chronograph to zero and an operating cam, arranged approximately in the center of the body of the device, for operating the zero reset lever.

In accordance with principles of the present invention, the entire zero reset mechanism is made compact and the body of the time measurement device is accordingly made compact, because the operating cam is arranged approximately in the center of the body of the device. With this arrangement, a great deal of flexibility is permitted in the layout and location of buttons.

A time measurement device of the present invention, includes a power source for supplying the driving power, generated by the generator, to the first and second motors. The power source includes a first power source unit and a second power source unit, charged with the driving power generated by the generator, for respectively supplying power to the first and second motors, and wherein the storage capacity of the second power source unit is smaller than the storage capacity of the first power source unit. Alternatively, the power source includes a first power source unit, charged with the driving power generated by the generator, for supplying power to the first and second motor, a voltage multiplication circuit for multiplying the driving power charged at the first power source unit, a voltage multiplication control circuit for controlling the voltage multiplication of the voltage multiplication circuit, and a second power source unit, charged with the driving power multiplied by the voltage multiplication circuit, for supplying power to the first and second motors.

In accordance with the present invention, since the power source once stores the driving power, generated by the generator, to supply each motor with the driving power, the time measurement device continuously operates for an extended period of time even when the generator is inoperative. The second power source unit, having the storage capacity smaller than that of the first power source unit, is charged, and the voltage of the second power source unit instantaneously rises and becomes high enough to drive the time measurement device, driving the first and second motors. With the voltage multiplication circuit used, the voltage, multiplied by the voltage multiplication circuit, charges the second power source unit, driving the motors, even when the charge voltage of the first power source unit is lowered, and the time measurement device continuously operates for an extended period of time.

In a time measurement device of the present invention, the chronograph includes a indicator having at least two units of time.

In accordance with the present invention, besides the display of standard time, time is presented in units of time of tenth second and 12 hours.

In a time measurement device of the present invention, the indicator is driven by the second motor.

In accordance with the present invention, the zero resetting of the chronograph is mechanically carried out. Since the indicator is driven by the second motor, a unit for converting mechanical energy into electrical energy works as a driving power source for the motor.

In a time measurement device of the present invention, the indicator includes train wheels.

In accordance with the present invention, since the indicator is operated through train wheels, a smooth operation is permitted in the time measurement device.

In a time measurement device of the present invention, the generator includes a generator rotor and a generator coil.

In accordance with the present invention, the generator rotor is rotated, generating the motor driving power in the generator coil by electromagnetic induction.

In a time measurement device of the present invention, the generator rotor is rotated by an oscillating weight.

In accordance with the present invention, the charging of the motor driving power is automated, because the generator rotor is rotated by the oscillating weight.

In a time measurement device of the present invention, the time measurement is a wristwatch.

In accordance with the present invention, the time measurement is constructed as a chronograph which is compact and free from battery replacement.

DESCRIPTION OF THE PREFERRED EMBODIMENTS

Figure 1:
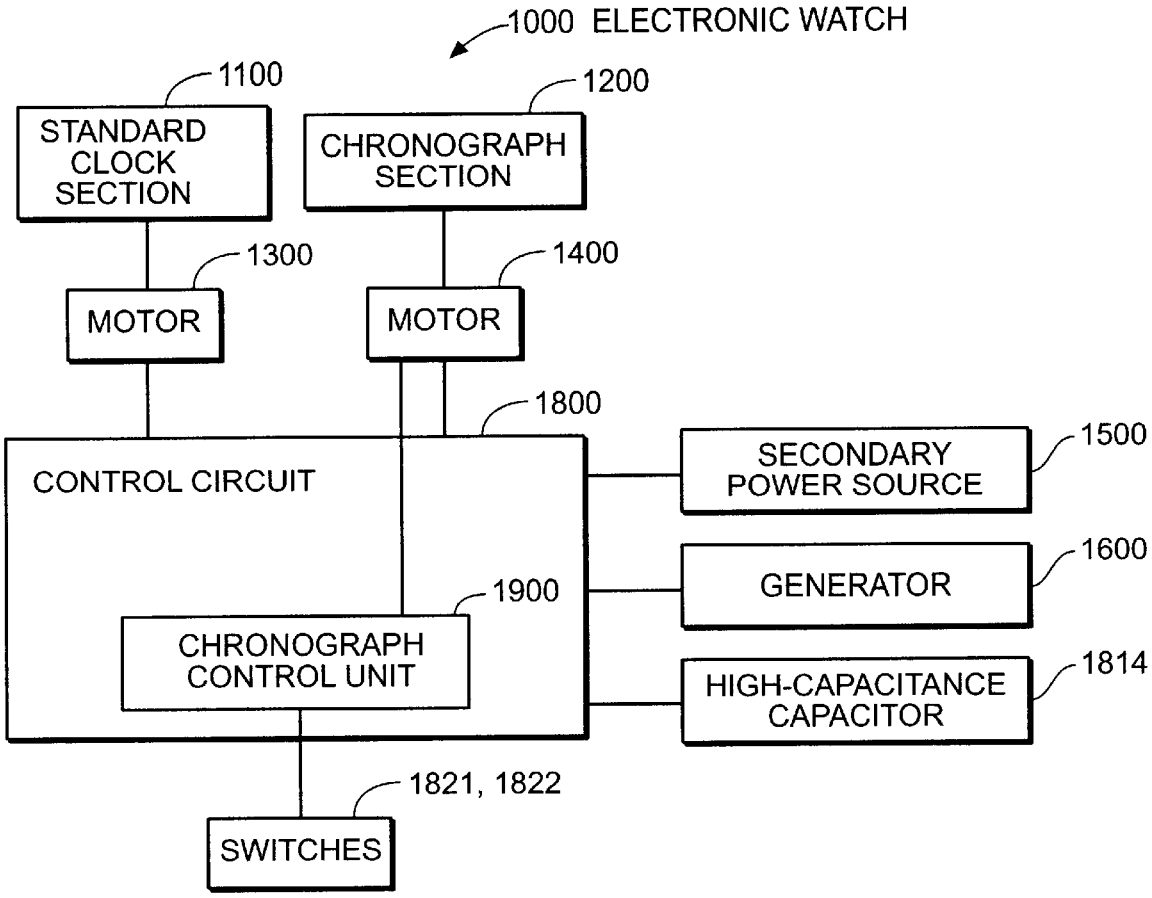
FIG. 1 is a block diagram representation of one embodiment of an electronic watch as a time measurement device of the present invention.

Best Mode for Carrying out the Invention

Referring to the drawings, preferred embodiments of the present invention are discussed.

FIG. 1 is a block diagram showing one embodiment of an electronic watch as a time measurement device of the present invention.

The electronic watch 1000 includes two motors 1300 and 1400 for respectively driving a standard clock section 1100 and a chronograph section 1200, a high-capacitance capacitor 1814, as a first power source unit, and a secondary power source 1500, as a second power source unit, for feeding power to drive the motors 1300 and 1400, a generator 1600 for charging the secondary power source 1500, and a control circuit 1800 for generally controlling the electronic watch 1000. The control circuit 1800 includes a chronograph control unit 1900 having switches 1821 and 1822 for controlling the chronograph section 1200 in a method to be described later. The secondary power source 1500 and the high-capacitance capacitor 1814 function as a power source for the electronic watch 1000. Besides the high-capacitance capacitor 1814 and the secondary power source 1500, a voltage multiplication circuit 1813 and a voltage multiplication control circuit 1815 also function as the power source for the electronic watch 1000, which voltage multiplies driving power charging the secondary power source 1500, to be described later (see FIG. 20) and arranged in a control circuit 1800, and then charges the high-capacitance capacitor 1814 with the multiplied voltage.

The electronic watch 1000 is an analog electronic watch having a chronograph function, and includes two motors 1300 and 1400, separately operated from power generated by a single generator 1600, for performing watch-hand driving for the standard clock section 1100 and the chronograph section 1200. The resetting (zero resetting) of the chronograph section 1200 is performed mechanically, rather than by motor driving.

Figure 2:
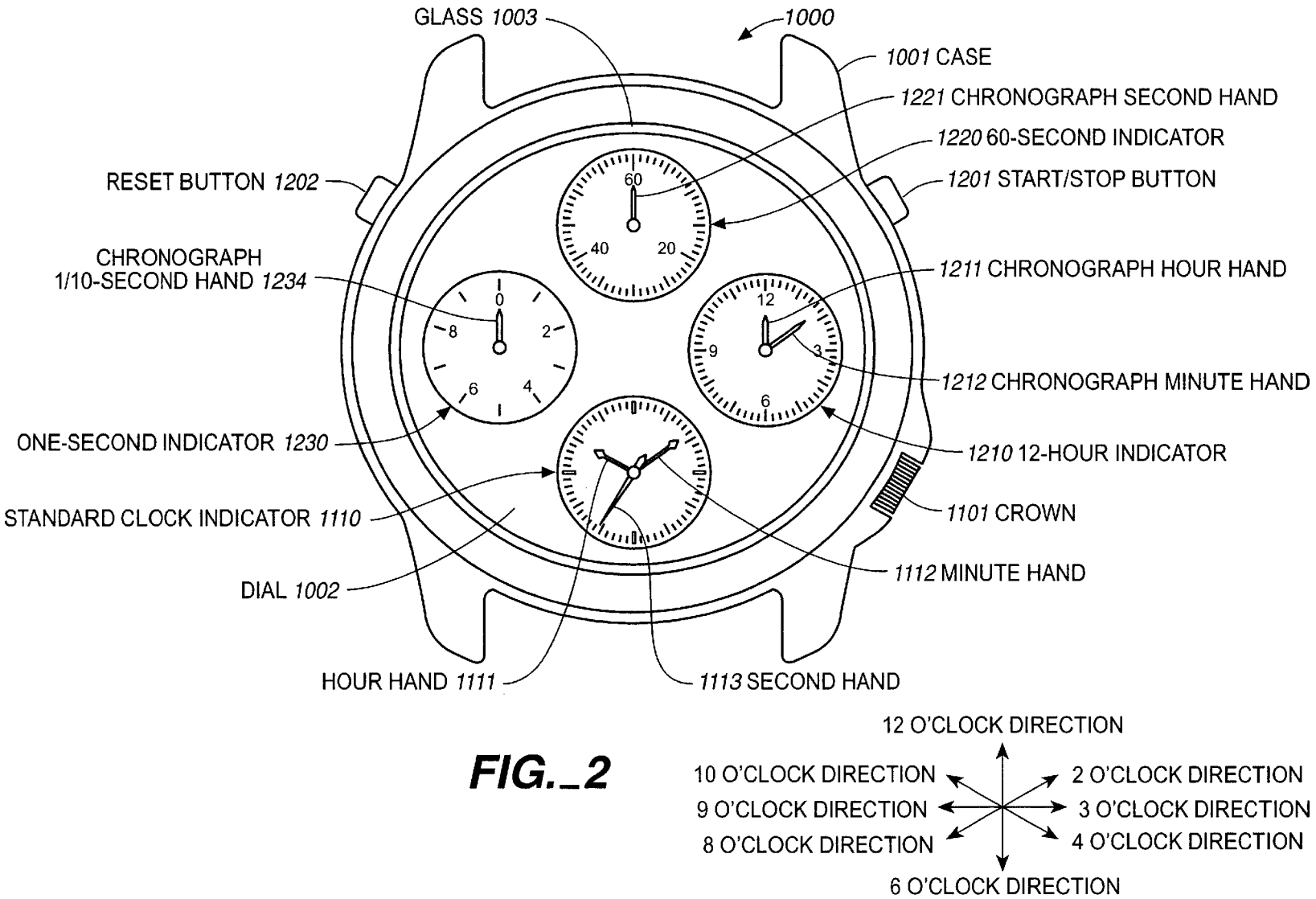
FIG. 2 is a top view showing a face of the electronic watch of FIG. 1.

FIG. 2 is a plan view showing the external appearance of the finished construction of the electronic watch shown in FIG. 1.

In the electronic watch 1000, a dial 1002 and a glass cover 1003 are fitted into a case 1001. A crown 1101 as an external control is mounted on the case 1001 at its 4 o'clock position, and a start/stop button (a first switch) 1201 and a reset button 1202 (a second switch) are respectively arranged at a 10 o'clock position and a 2 o'clock position.

A standard clock indicator 1110 having an hour hand 1111, a minute hand 1112, and a second hand 1113 as watch hands for indicating standard time is arranged at 6 o'clock position of the dial 1002, and indicators 1210, 1220, and 1230 having chronograph auxiliary hands are arranged at 3 o'clock, 12 o'clock, and 9 o'clock positions respectively, of the dial. Specifically, the 12-hour indicator 1210 having chronograph hour and minute hands 1211 and 1212, respectively, is arranged at the 3 o'clock position of the dial, the 60-second indicator 1220, having a chronograph second hand 1221, is arranged at the 12 o'clock position of the dial, and the one-second indicator 1230, having a chronograph 1/10-second hand 1234 is arranged at the 9 o'clock position of the dial. Since the indicators 1210, 1220, and 1230 with chronograph hands are arranged in locations other than the center portion of the body of the electronic watch 1000, an operating cam 1240 for the zero reset mechanism, to be described later (see FIG. 8), is arranged approximately in the center of the body of the electronic watch 1000.

Figure 3:
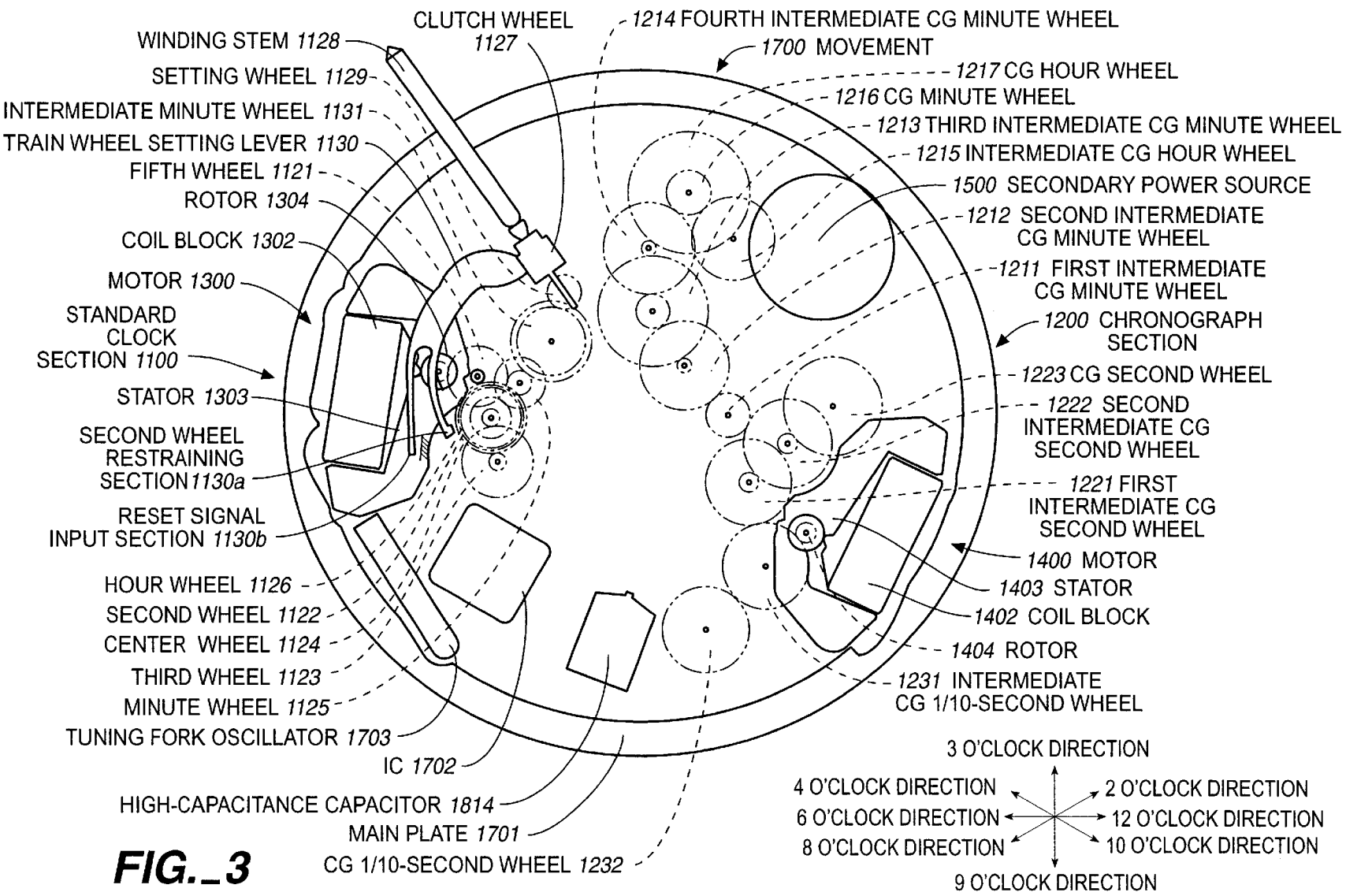
FIG. 3 is an elevation view roughly showing the construction of the internal parts of the electronic watch.

FIG. 3 is a plan view roughly showing a movement of the electronic watch of FIG. 2, when viewed from behind it.

The movement 1700 includes, at the 6 o'clock position of a main plate 1701, the standard clock section 1100, the motor 1300, IC 1702, a tuning fork oscillator 1703, etc, and, at the 12 o'clock position of the main plate 1701, the chronograph section 1200, the motor 1400, and the secondary power source 1500 such as a lithium ion power source.

The motors 1300 and 1400 are step motors, and respectively include coil blocks 1302 and 1402, each having a core constructed of a high-permeability material, stators 1303 and 1403, each constructed of a high-permeability material, and rotors 1304 and 1404, each composed of a rotor magnet and a rotor pinion.

The standard clock section 1100 includes train wheels of a fifth wheel 1121, a second wheel 1122, a third wheel 1123, a center wheel 1124, a minute wheel 1125, 10 and an hour wheel 1126. The arrangement of these train wheels presents the seconds, minutes and hours of standard time.

Figure 4:
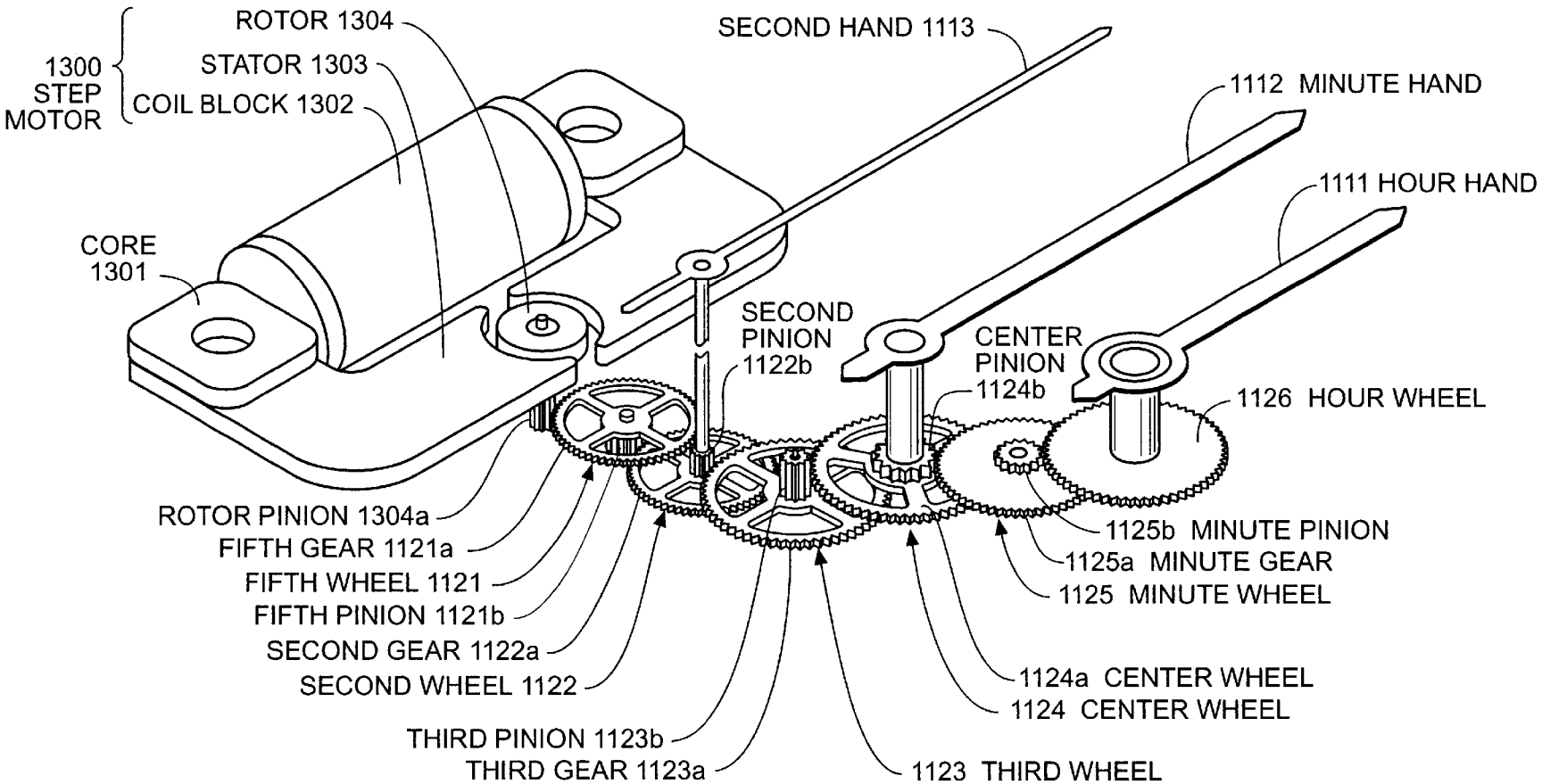
FIG. 4 is a perspective view showing an engagement state of train wheels in the standard clock section of the electronic watch shown in FIG. 3.

FIG. 4 is a perspective view showing an engagement state of the train wheels in the standard clock section 1100.

A rotor pinion 1304*a* is in mesh with a fifth gear 1121*a*, and a fifth pinion 1121*b* is in mesh with a second gear 1122*a*. The rotor pinion 1304*a* through the second gear 1122*a* feature a gear reduction ratio of 1/30. An electrical signal from IC 1702 is output to cause a rotor 1304 to rotate half a revolution per second, the second wheel 1122 rotates once every 60 seconds, and the second hand 1113, attached to one end of the shaft of the second wheel 1122, indicates the seconds of standard time.

The second pinion 1122*b* is in mesh with a third gear 1123*a*, and a third pinion 1123*b* is in mesh with a center gear 1124*a*. The second pinion 1122*b* through the center gear 1124*a* feature a gear reduction ratio of 1/60. The center wheel 1124 rotates once every 60 minutes, and the minute hand 1112, attached to one end of the shaft of the center wheel 1124, indicates the minutes of standard time.

A center pinion 1124*b* is in mesh with a minute gear 1125*a*, and a minute pinion 1125*b* is in mesh with the hour wheel 1126. The center pinion 1124*b* through the hour wheel 1126 feature a gear reduction ratio of 1/12, and the hour wheel 1126 rotates once every 12 hours, and the hour hand 1111, attached to one end of the shaft of the hour wheel 1126, indicates the hours of standard time.

Referring to FIG. 2 and FIG. 3, the standard clock section 1100 includes a winding stem 1128, one end to which the crown 1101 is connected and the other end to which a clutch wheel 1127 is attached, a setting wheel 1129, winding stem setting means, and a train wheel setting lever 1130. The winding stem 1128 is stepwise pulled out with the crown 1101. The winding stem 1128, when not in its pulled state (zero step), is in its normal state. When the winding stem 1128 is pulled out to a first step, calendar correction is performed without stopping the hour hand 1111 and the like, and when the winding step 1128 is pulled out to a second step, the watch hand driving is suspended permitting the user to set time.

When the winding stem 1128 is pulled out to the second step by pulling the crown 1101, a reset signal input section 1130*b* arranged on the train wheel setting lever 1130, which is engaged with the winding stem setting means, is put into contact with a pattern of a circuit board having IC 1702 thereon, and the output of motor pulse stops, suspending the watch-hand driving. Then, a second wheel restraining section 1130*a*, arranged on the train wheel setting lever 1130, restrains the rotation of the second gear 1122*a*. When the crown 1101 is rotated along with the winding stem 1128 in this state, the rotation of the crown 1101 is transmitted to the minute wheel 1125 through the clutch wheel 1127, setting wheel 1129, and intermediate minute wheel 1131. Since the center gear 1124*a* is coupled with the center pinion 1124*b* with a constant slip permitted therebetween, the setting wheel 1129, minute wheel 1125, center pinion 1124*b*, and hour wheel 1126 are still rotatable even if the second wheel 1122 is restrained. The minute hand 1112 and hour hand 1111 still turn, permitting the user to set time.

Referring to FIG. 2 and FIG. 3, the chronograph section 1200 includes train wheels of an intermediate CG (chronograph) 1/10-second wheel 1231, CG 1/10-second wheel 1232, the CG 1/10-second wheel 1232 is arranged in the center of the one-second indicator 1230. The arrangement of these train wheels presents the tenths of a second of the chronograph at the 9 o'clock position of the watch body.

Referring to FIG. 2 and FIG. 3, the chronograph section 1200 includes train wheels of a first intermediate CG second wheel 1221, a second intermediate CG second wheel 1222, a CG second wheel 1223, and the CG second wheel 1223 is arranged in the center of the 60-second indicator 1220. This arrangement of train wheels indicates the seconds of chronograph at the 12 o'clock position of the watch body.

Referring to FIG. 2 and FIG. 3, the chronograph section 1200 includes train wheels of a first intermediate CG minute wheel 1211, a second intermediate CG minute wheel 1212, a third intermediate CG minute wheel 1213, a fourth intermediate minute wheel 1214, an intermediate CG hour wheel 1215, a CG minute wheel 1216, and a CG hour wheel 1217, the CG minute wheel 1216 and CG hour wheel 1217 are coaxially arranged in the center of the 12-hour indicator 1210. This arrangement of these train wheels indicates the hours of the chronograph at the 3 o'clock position of the watch body.

Figure 5:
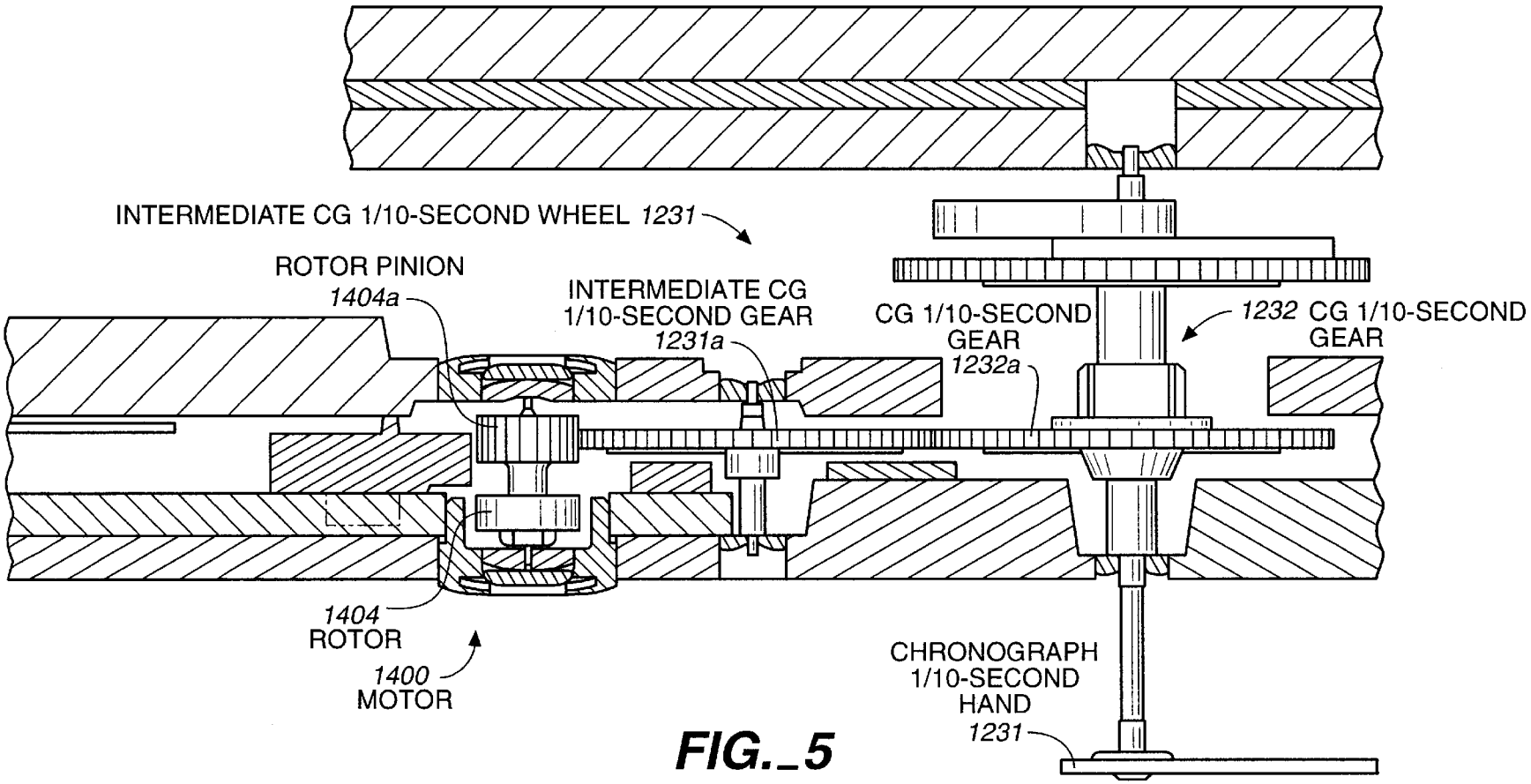
FIG. 5 is a sectional side view showing the engagement state of train wheels for indicating the tenths of a second of the chronograph of the electronic watch shown in FIG. 2.

FIG. 5 is a sectional side view showing the engagement state of train wheels for indicating the tenths of a second of the chronograph section 1200.

A rotor pinion 1404*a* is in mesh with an intermediate CG 1/10-second gear 1231*a*, which, in turn, is in mesh with a CG 1/10-second gear 1232*a*. The rotor pinion 1404*a* through the CG 1/10-second gear 1232*a* feature a gear reduction ratio of 1/5. IC 1702 outputs an electrical signal so that the rotor 1404 rotates one half a revolution per one-tenth second. The CG 1/10-second wheel 1232 rotates one revolution per second, and the chronograph 1/10-second hand 1231, attached to one end of the shaft of the CG 1/10-second wheel 1232, indicates the tenths of a second of the chronograph.

Figure 6:
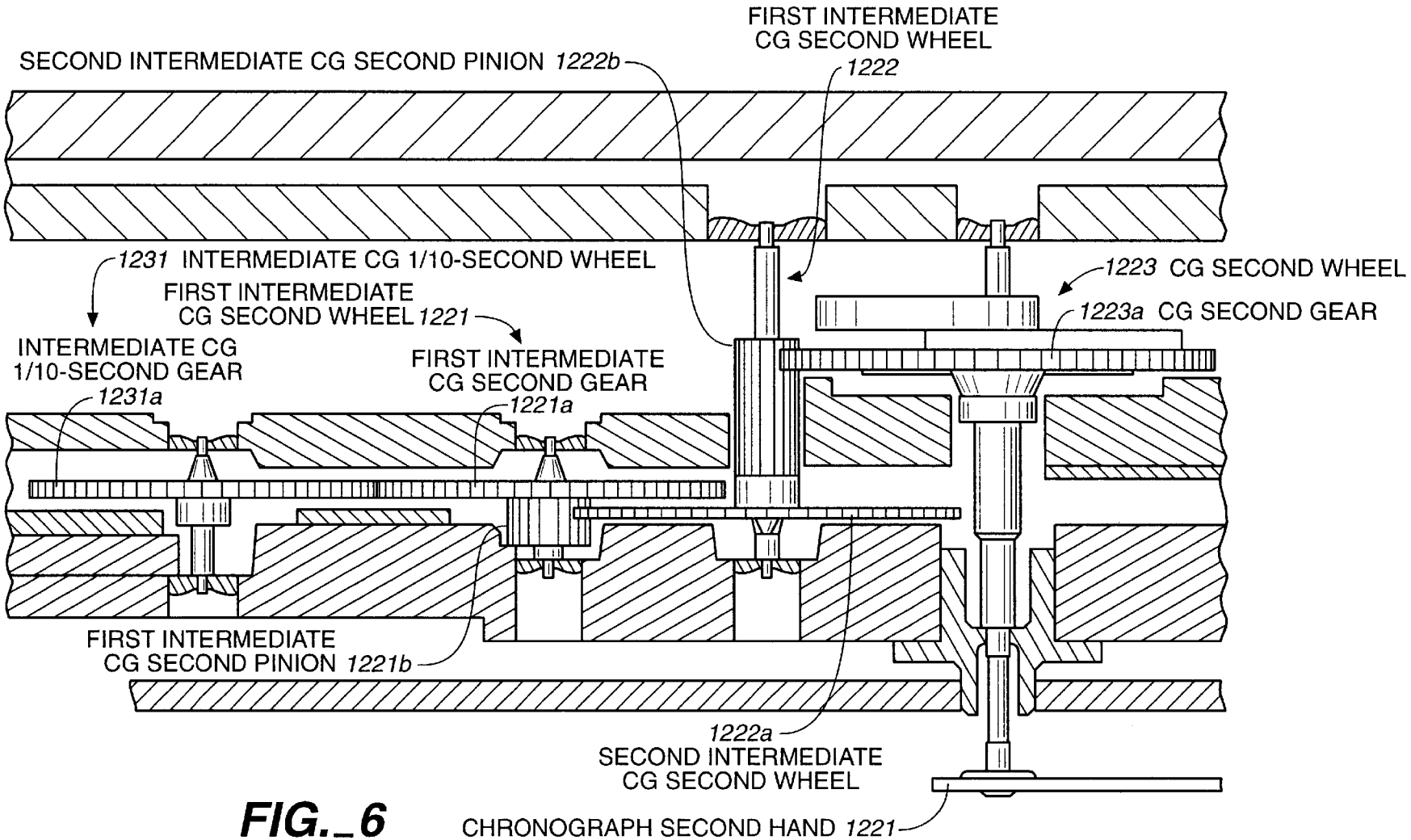
FIG. 6 is a sectional side view showing the engagement state of train wheels for indicating the seconds of the chronograph of the electronic watch shown in FIG. 2.

FIG. 6 is a sectional side view showing the engagement of train wheels in the chronograph section 1200 for indicating the seconds of the chronograph.

The intermediate CG 1/10-second gear 1231*a* is in mesh with a first intermediate CG second gear 1221*a*, and a first intermediate CG second pinion 1221*b* is in mesh with a second intermediate CG second gear 1222*a*. A second intermediate CG second pinion 1222*b* is in mesh with a CG second gear 1223*a*. An intermediate CG 1/10-second gear 1231*a* is in mesh with the rotor pinion 1404*a*, as already described, and the rotor pinion 1404*a* through the CG second gear 1223*a* feature a reduction gear ratio of 1/300. The CG second wheel 1223 rotates one revolution every 60 seconds, and the chronograph second hand 1221, attached to one end of the shaft of the CG second wheel 1223, indicates the seconds of the chronograph.

Figure 7:
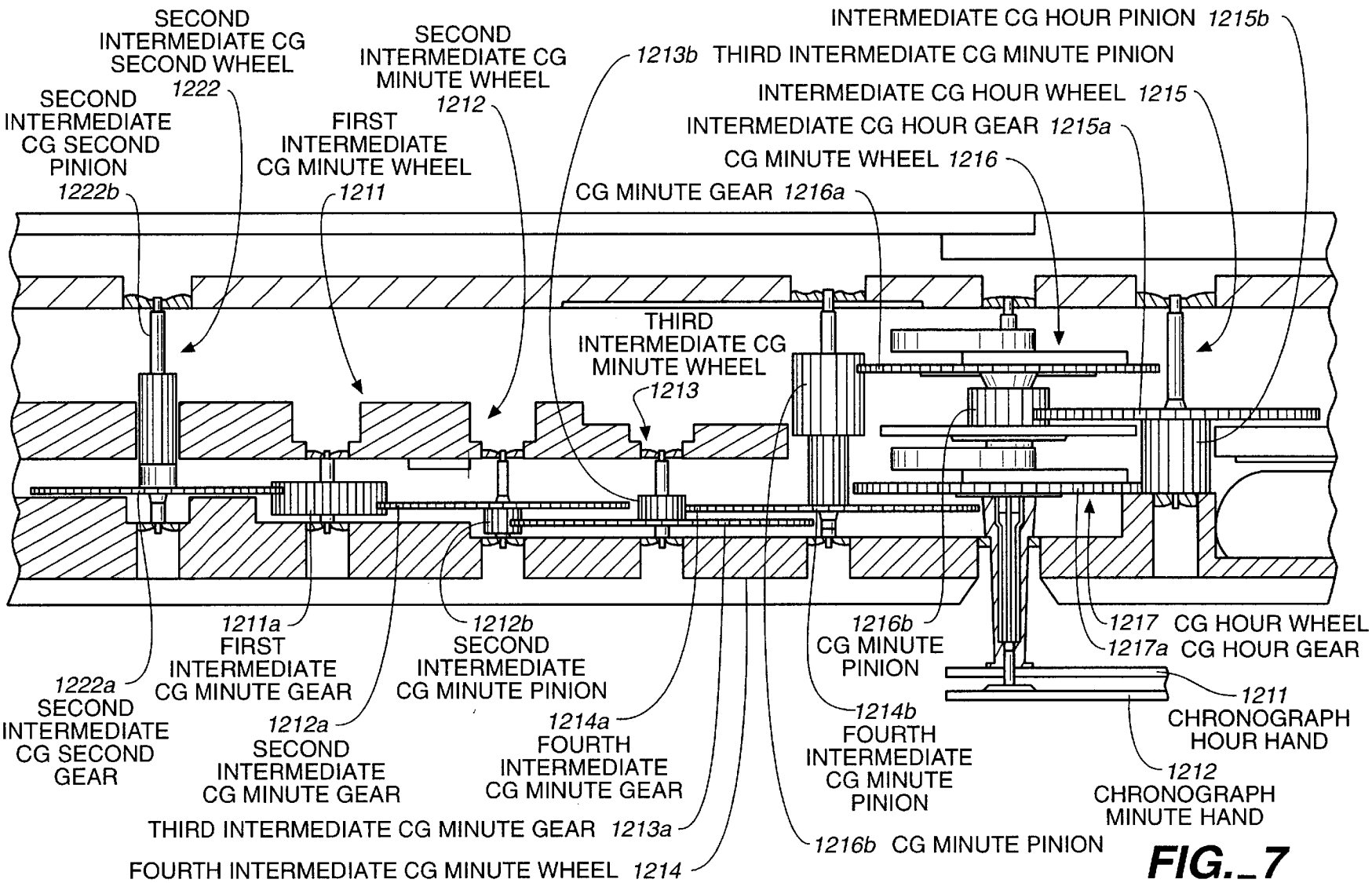
FIG. 7 is a sectional side view showing the engagement state of train wheels for indicating the minutes and hours of the chronograph of the electronic watch shown in FIG. 2.

FIG. 7 is a sectional side view showing the engagement state of train wheels in the chronograph section 1200 for indicating the minutes and hours.

A second intermediate CG second gear 1222*a* is in mesh with a first intermediate CG minute gear 1211*a*, which, in turn, is in mesh with a second intermediate CG minute gear 1212*a*. A second intermediate CG minute pinion 1212*b* is in mesh with a third intermediate CG minute gear 1213*a*, and a third intermediate CG minute pinion 1213*b* is in mesh with a fourth intermediate CG minute gear 1214*a*. A fourth intermediate CG minute pinion 1214*b* is in mesh with a CG minute gear 1216*a*. A CG minute pinion 1216*b* is in mesh with an intermediate CG hour gear 1215*a*, and an intermediate CG hour pinion 1215*b* is in mesh with a CG hour gear 1217*a*. Referring to FIGS. 5, 6, and 7, the rotor 1404 through the CG minute gear 1216*a* feature a gear reduction ratio of 1/18000, and the CG minute wheel 1216 rotates one revolution every 60 minutes. The chronograph minute hand 1212, attached to one end of the shaft of the CG minute wheel 1216, indicates the minutes of the chronograph. The CG minute pinion 1216*b* through the CG hour gear 1217*a* feature a gear reduction ratio of 1/12, and the CG hour wheel 1217 rotates one revolution every 12 hours. The chronograph hour hand 1211, attached to one end of the shaft of the CG hour wheel 1217, indicates the hours of the chronograph.

Figure 8:
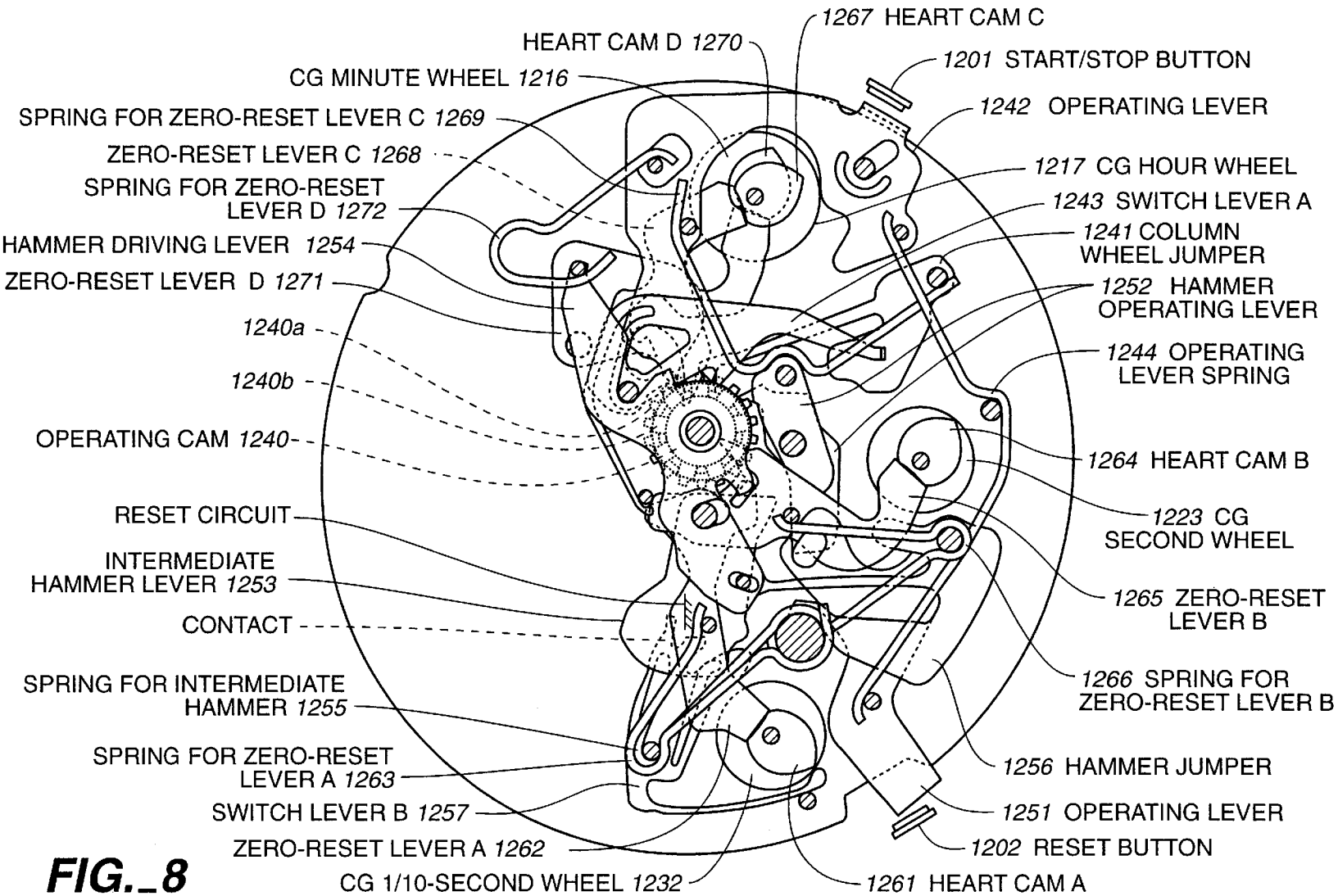
FIG. 8 is a plan view roughly showing an operating mechanism for start/stop and (zero) reset in a chronograph section of the electronic watch of FIG. 2.
Figure 9:
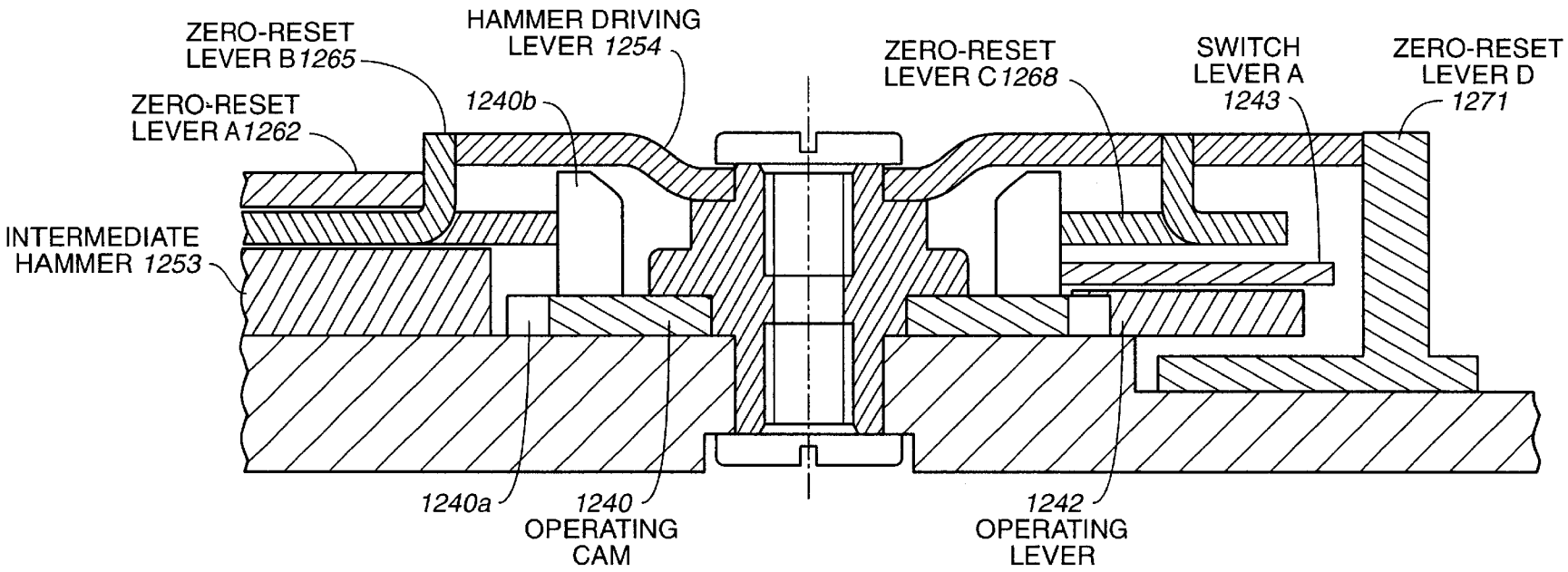
FIG. 9 is a sectional side view roughly showing a major portion of the operating mechanism for start/stop and (zero) reset in the chronograph section of FIG. 8.

FIG. 8 is a plan view roughly showing the operating mechanisms for start/stop and resetting (zero resetting) in the chronograph section 1200, when viewed from a back side of the wall. FIG. 9 is a sectional side view roughly showing a major portion of the operating mechanism. These figures show the reset state of the watch.

The operating mechanisms for start/stop and resetting of the chronograph section 1200 are arranged on the movement shown in FIG. 3, and the start/stop and reset operations are mechanically carried out with an operating cam 1240 rotating almost in the center of the movement. The operating cam 1240 has a cylindrical shape, and has teeth 1240*a* arranged around the circumference at a regular pitch, and a ring of columns 1240*b* at a regular pitch on one end thereof. The operating cam 1240 is restrained in phase during a stationary state by a column wheel jumper 1241 engaged between adjacent teeth 1240*a* and is counterclockwise rotated by an operating cam rotary portion 1242*d* attached to the end of an operating lever 1242.

Figure 10:
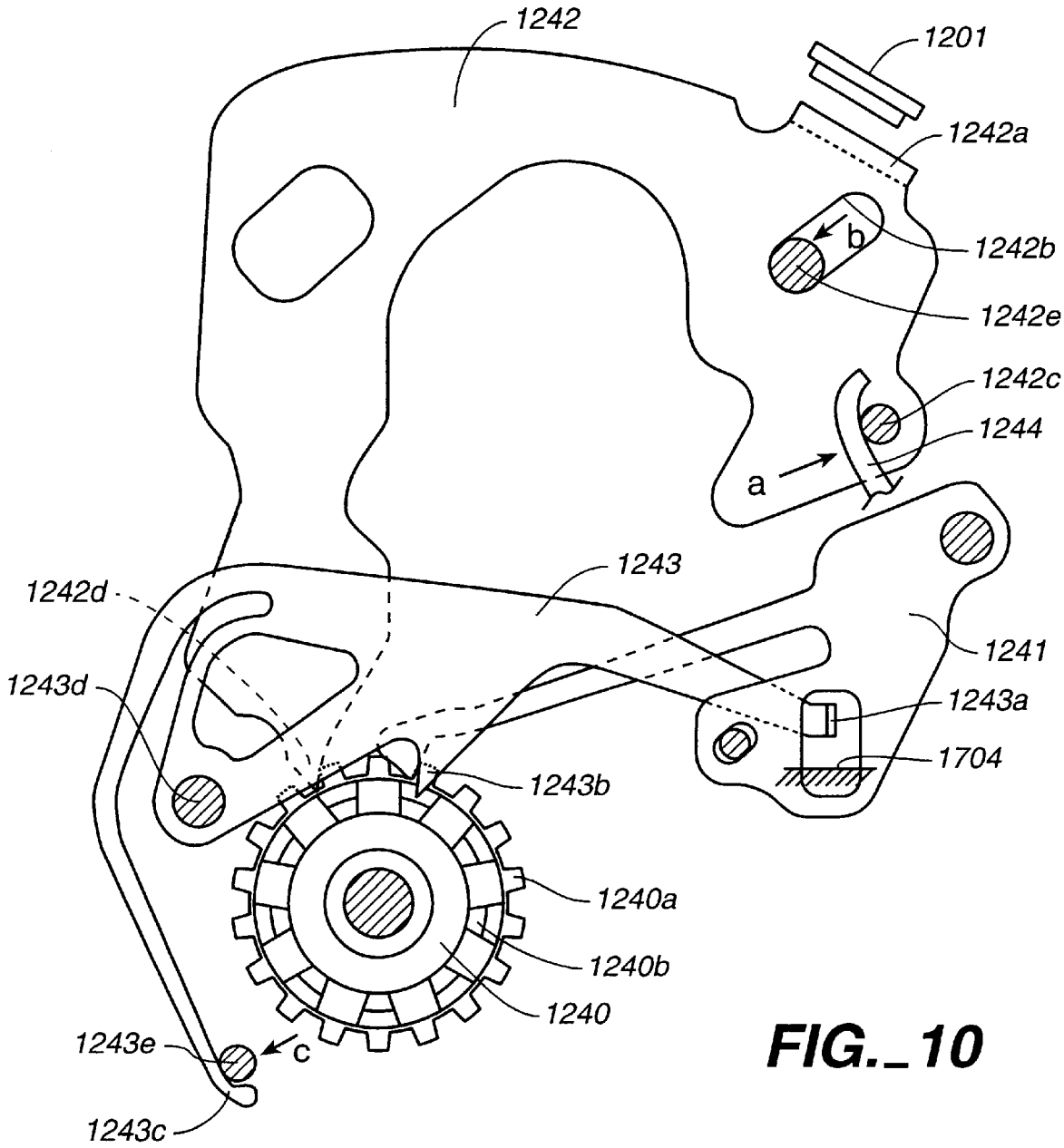
FIG. 10 is a first plan view showing the operational example of the start/stop operating mechanism in the chronograph of FIG. 8.

The start/stop operating mechanism, as shown in FIG. 10, includes the operating lever 1242, a switch lever A1243, and an operating lever spring 1244.

The operating lever 1242, having a generally L-shape planar structure, includes, on one end, a pressure portion 1242*a*, formed in a bent state, an elliptical through hole 1242*b*, and a pin 1242*c*, and on the other end, an acute angle pressure portion 1242*d*. Such an operating lever 1242 constitutes the start/stop operating mechanism, in which the pressure portion 1242*a* faces the start/stop button 1201, a pin 1242*e*, affixed to the movement, is received within the through hole 1242*b*, the pin 1242*c* is engaged with one end of the operating lever spring 1244, and the pressure portion 1242*d* is placed in the vicinity of the operating cam 1240.

The switch lever A1243 has, on one end, a switch portion 1243*a*, on its generally central position, a planar projection 1243*b*, and on the other end, a lock portion 1243*c*. Such a switch lever A1243, on its almost central position, is pivotally supported about a pin 1243*d*, which is affixed to the movement, and constitutes the start/stop operating mechanism, in which the switch portion 1243*a* is placed in the vicinity of a start circuit of a circuit board 1704, the projection 1243*b* is placed to be in contact with the column 1240*b* extending longitudinally along the operating cam 1240, and the lock portion 1243*c*is engaged with the pin 1243*e* affixed to the movement. Specifically, the switch portion 1243*a* of the switch lever A1243 is put into contact with the start circuit of the circuit board 1704, thereby turning the switch on. The switch lever A1243, electrically connected to the secondary power source 1500 via the main plate 1701, etc., has the same potential as that of the positive electrode of the secondary power source 1500.

The operational example of the start/stop operating mechanism thus constructed is now discussed in connection with the startup operation of the chronograph section 1200, referring to FIG. 10 through FIG. 12.

When the chronograph section 1200 is in a stop state, the operating lever 1242 is set, as shown in FIG. 10, as follows: the pressure portion 1242*a* is disengaged from the start/stop button 1201, the pin 1242*c* is urged under the elastic force of the operating lever spring 1244 in the direction of an arrow "a" as shown, and the through hole 1242*b* is positioned with the pin 1242*e* abutting one end of the through hole 1242*b* in the direction of an arrow "b" as shown. The end portion 1242*d* of the operating lever 1242 is positioned between adjacent teeth 1240*a* of the operating cam 1240.

The switch lever A1243 is set as follows: the projection 1243*b* is outwardly pressed by the column 1240*b* of the operating cam 1240 against the urging of the spring portion 1243*c* on the other end of the switch lever A1243, and the switch lever A1243 is thus positioned under the urging of the pin 1243*e* in the direction of an arrow c as shown. The switch portion 1243*a* of the switch lever A1243 remains detached from the start circuit of the circuit board 1704, and the start circuit is electrically not conductive.

Figure 11:
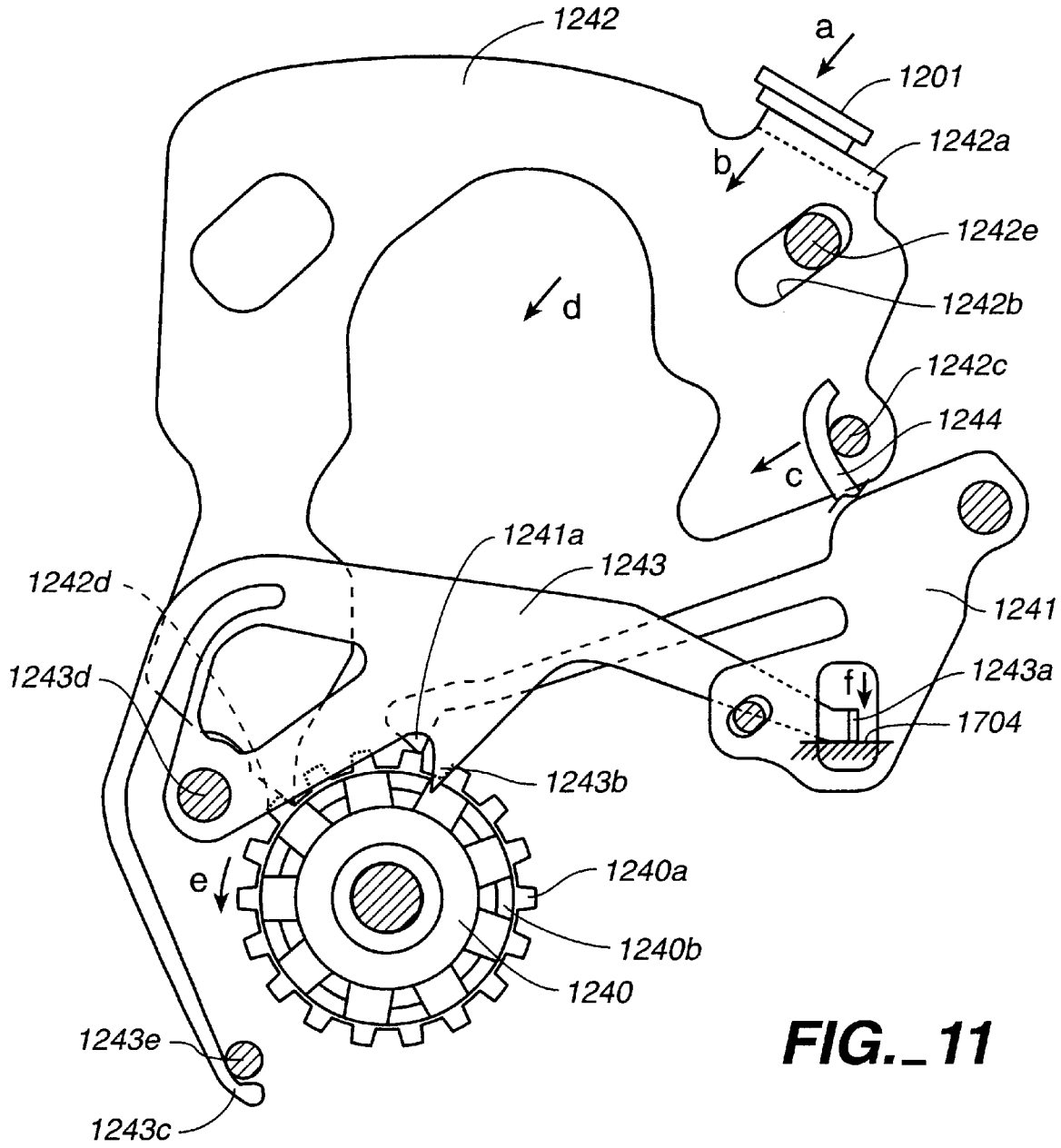
FIG. 11 is a second plan view showing the operational example of the start/stop operating mechanism in the chronograph of FIG. 8.

When the start/stop button 1201 is pressed in the direction of an arrow "a" as shown in FIG. 11 to activate the chronograph section 1200 from the above state, the start/stop button 1201 is put into contact with the pressure portion 1242*a* of the operating lever 1242, thereby pressing the pressure portion 1242*a* in the direction of an arrow "b" as shown. The pin 1242*c* presses and elastically deforms the operating lever spring 1244 in the direction of an arrow "c" as shown. The entire operating lever 1242 moves in the direction of an arrow "d" with the through hole 1242*b* and the pin 1242*e* working as guides. The end portion 1242*d* of the operating lever 1242 abuts the side face of the tooth 1240*a* of the operating cam 1240, thereby rotating the operating cam 1240 in the direction of an arrow "e" as shown.

The rotation of the operating cam 1240 causes the projection 1243*b* of the switch lever A1243 to be out of phase with the side face of the column 1240*b*, and the projection 1243*b* comes and is placed between columns 1240*b* by means of the restoring force of the spring portion of the 1243*c*. The switch portion 1243*a* of the switch lever A1243 pivots in the direction of an arrow "f", as shown, contacting the start circuit of the circuit board 1704 and driving the start circuit into an electrically conductive state.

An end portion 1241*a* of the column wheel jumper 1241 is now pressed outwardly by the tooth 1240*a* of the operating cam 1240.

The above operation continues until the teeth 1240*a* of the operating cam 1240 is rotated by one pitch.

Figure 12:
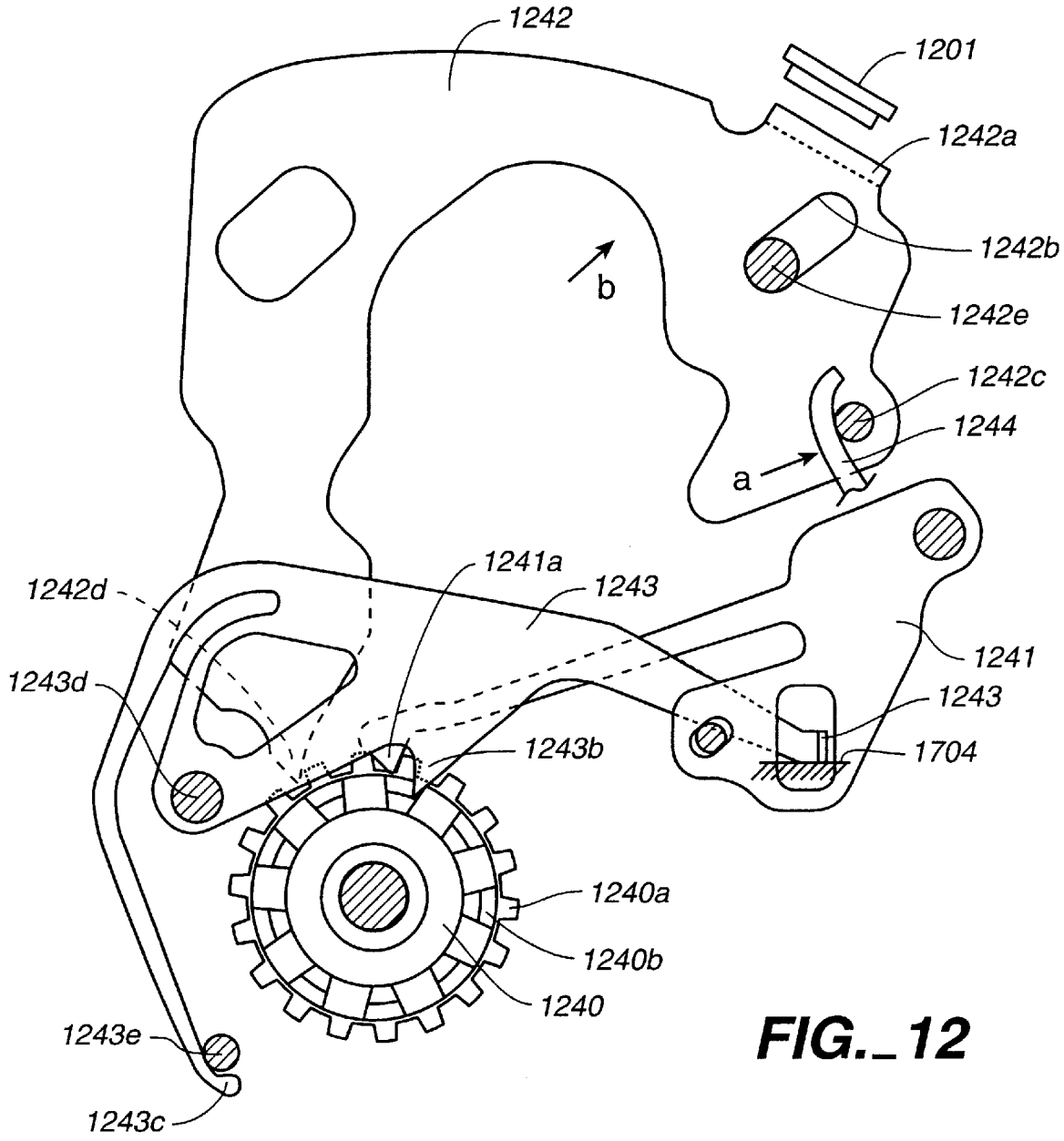
FIG. 12 is a third plan view showing the operational example of the start/stop operating mechanism in the chronograph of FIG. 8.

When the user releases the start/stop button 1201, the start/stop button 1201 automatically reverts back to its original state by means of a built-in spring as shown in FIG. 12. The pin 1242*c* of the operating lever 1242 is urged by the restoring force of the operating lever spring 1244 in the direction of an arrow "a". The entire operating lever 1242 moves with the through hole 1242*b* and the pin 1242*e* working as the guides in the direction of an arrow "b" until the one end side wall of the through hole 1242*b* abuts the pin 1242*e*, and thereby the operating lever 1242 reverts back to its position as shown in FIG. 10.

The projection portion 1243*b* of the switch lever A1243 remains inserted in the space between one column 1240*b* and another column 1240*b* of the operating cam 1240, the switch portion 1243*a* remains in contact with the start circuit of the circuit board 1704, and the start circuit maintains its electrically conductive state. The chronograph section 1200 therefore maintains its start state.

The projection portion 1241*a* of the column wheel jumper 1241 is inserted between adjacent teeth 1240*a* and another tooth 1240*a* of the operating cam 1240, and sets the phase in the rotation of the operating cam 1240 in its stationary state.

To stop the chronograph section 1200, the same operation as that at the start is carried out, and the chronograph section 1200 reverts back to the state shown in FIG. 10.

As described above, pushing in the start/stop button 1201 moves the operating lever 1242, rotating the operating cam 1240, and pivoting the switch lever A1243, and the start/stop operation of the chronograph section 1200 is thus controlled.

Referring to FIG. 8, the reset operating mechanism includes the operating cam 1240, operating lever 1251, hammer operating lever 1252, intermediate hammer 1253, hammer driving lever 1254, operating lever spring 1244, intermediate hammer spring 1255, hammer jumper 1256, and switch lever B1257. The reset operating mechanism further includes a heart cam A1261, zero reset lever A1262, zero reset lever A spring 1263, heart cam B1264, zero reset lever B1265, zero reset lever B spring 1266, heart cam C1267, zero reset lever C1268, zero reset lever C spring 1269, heart cam D1270, zero reset lever D1271, and zero reset lever D spring 1272.

The reset operating mechanism of the chronograph section 1200 is designed not to be activated at the start state of the chronograph section 1200 but is designed to be activated at the stop state of the chronograph section 1200. This system is called a safety mechanism, and the safety mechanism, composed of the operating lever 1251, hammer operating lever 1252, intermediate hammer 1253, operating lever spring 1244, intermediate hammer spring 1255, and hammer jumper 1256, is now discussed, referring to FIG. 13.

The operating lever 1251, having a generally Y-shape planar structure, includes a pressure portion 1251*a* on one end, an elliptical through hole 1251*b* near one bifurcated end, and a pin 1251*c* at a midway point between the pressure portion 1251*a* and the through hole 1251*b*. The operating lever 1251 constitutes the reset operating mechanism, in which the pressure portion 1251*a* faces a reset button 1202, a pin 1252*c* of the hammer operating lever 1252 is received within the through hole 1251*b*, the other bifurcated end of the operating lever 1251 is pivotally supported about a pin 1251*d* affixed to the movement, and the pin 1251*c* is engaged with the other end of the operating lever spring 1244.

The hammer operating lever 1252 is composed of a first hammer operating lever member 1252*a* and a second hammer operating lever member 1252*b*, each having a generally rectangular planar structure. The first hammer operating lever member 1252*a* and second hammer operating lever member 1252*b* are stacked and mutually pivotally supported about a shaft 1252*g*. The pin 1252*c* is attached to one end of the first hammer operating lever member 1252*a*, and the second hammer operating lever member 1252*b* has a pressure portion 1252*d* and a pressure portion 1252*e* on both ends. The hammer operating lever 1252 constitutes the reset operating mechanism, in which the pin 1252*c* is received within the through hole 1251*b* of the operating lever 1251, the other end of the first hammer operating lever member 1252*a* is pivotally supported at a pin 1252*f* affixed to the movement, the pressure portion 1252*d* faces a pressure portion 1253*c* of the intermediate hammer 1253, and the pressure portion 1252*e* is positioned in the vicinity of the operating cam 1240.

The intermediate hammer 1253, having a generally rectangular planar structure, includes, a pin 1253*a* on one end portion, a pin 1253*b* in the middle portion, and the pressure portion 1253*c* near one corner of the other end portion. The intermediate hammer 1253 constitutes the reset mechanism, in which one end of the intermediate hammer spring 1255 is anchored at the pin 1253*a*, one end of the hammer jumper 1256 is engaged with the pin 1253*b*, the pressure portion 1253*c* faces the pressure portion 1252*d* of the second hammer operating lever member 1252*b*, and the one corner of the other end of the intermediate hammer 1253 is pivotally supported at the pin 1253*d* affixed to the movement.

The operational example of the safety mechanism thus constructed is now discussed, referring to FIG. 13 through FIG. 16.

Figure 13:
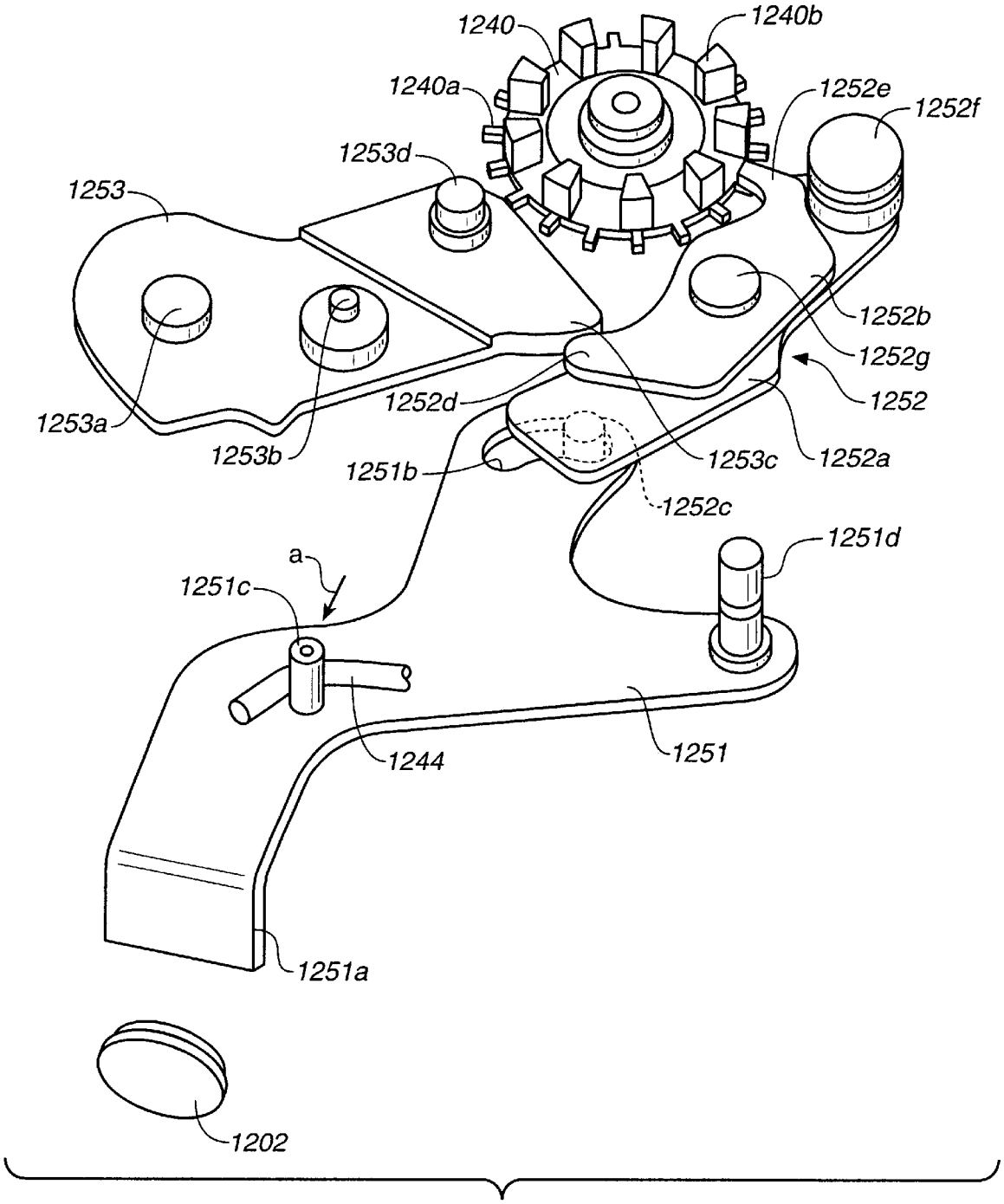
FIG. 13 is a first perspective view showing the operational example of a safety mechanism in the chronograph of FIG. 8.

When the chronograph section 1200 is in the start state, the operating lever 1251 is positioned as shown in FIG. 13 so that the pressure portion 1251*a* is detached from the reset button 1202, and the pin 1251*c* is urged under the elastic force of the operating lever spring 1244 in the direction of an arrow "a" as shown. The pressure portion 1252*e* of the second hammer operating lever member 1252*b* then stays out of the space between columns 1240*b* of the operating cam 1240.

Figure 14:
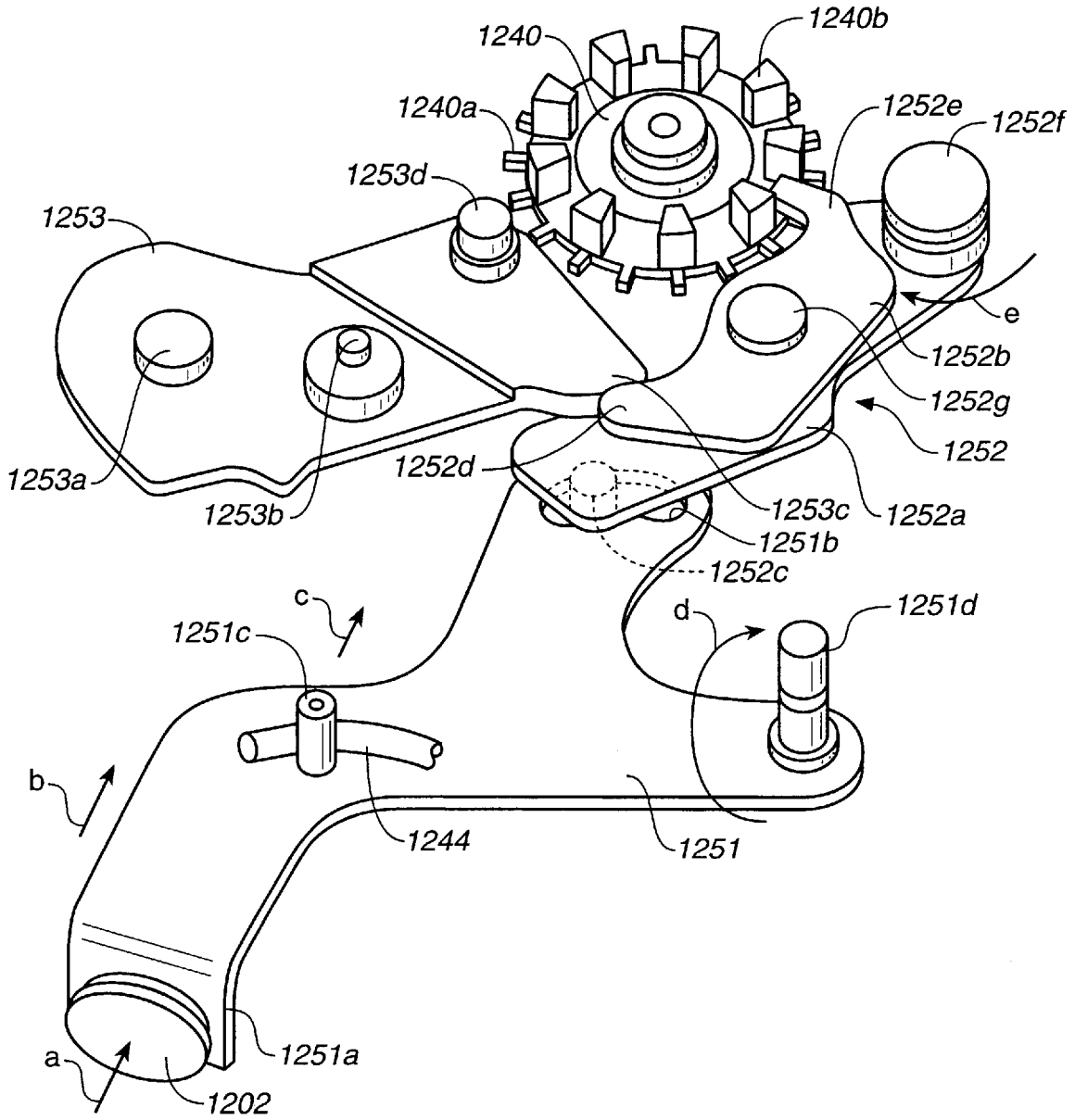
FIG. 14 is a second perspective view showing the operational example of the safety mechanism in the chronograph of FIG. 8.

When the reset button 1202 is pressed in the direction of an arrow "a" as shown in FIG. 14 in the above state, the reset button 1202 abuts and presses the pressure portion 1251*a* of the operating lever 1251 in the direction of an arrow "b" as shown, and the pin 1251*c* presses and elastically deforms the operating lever spring 1244 in the direction of an arrow "c" as shown. The entire operating lever 1251 pivots about the pin 1251*d* in the direction of an arrow "d" as shown. Along with its pivotal motion, the operating lever 1251 moves the pin 1252*c* of the first hammer operating lever member 1252*a* along the through hole 1251*b* of the operating lever 1251. The first hammer operating lever member 1252*a* thus pivots about the pin 1252*f* in the direction of an arrow "e" as shown.

Figure 15:
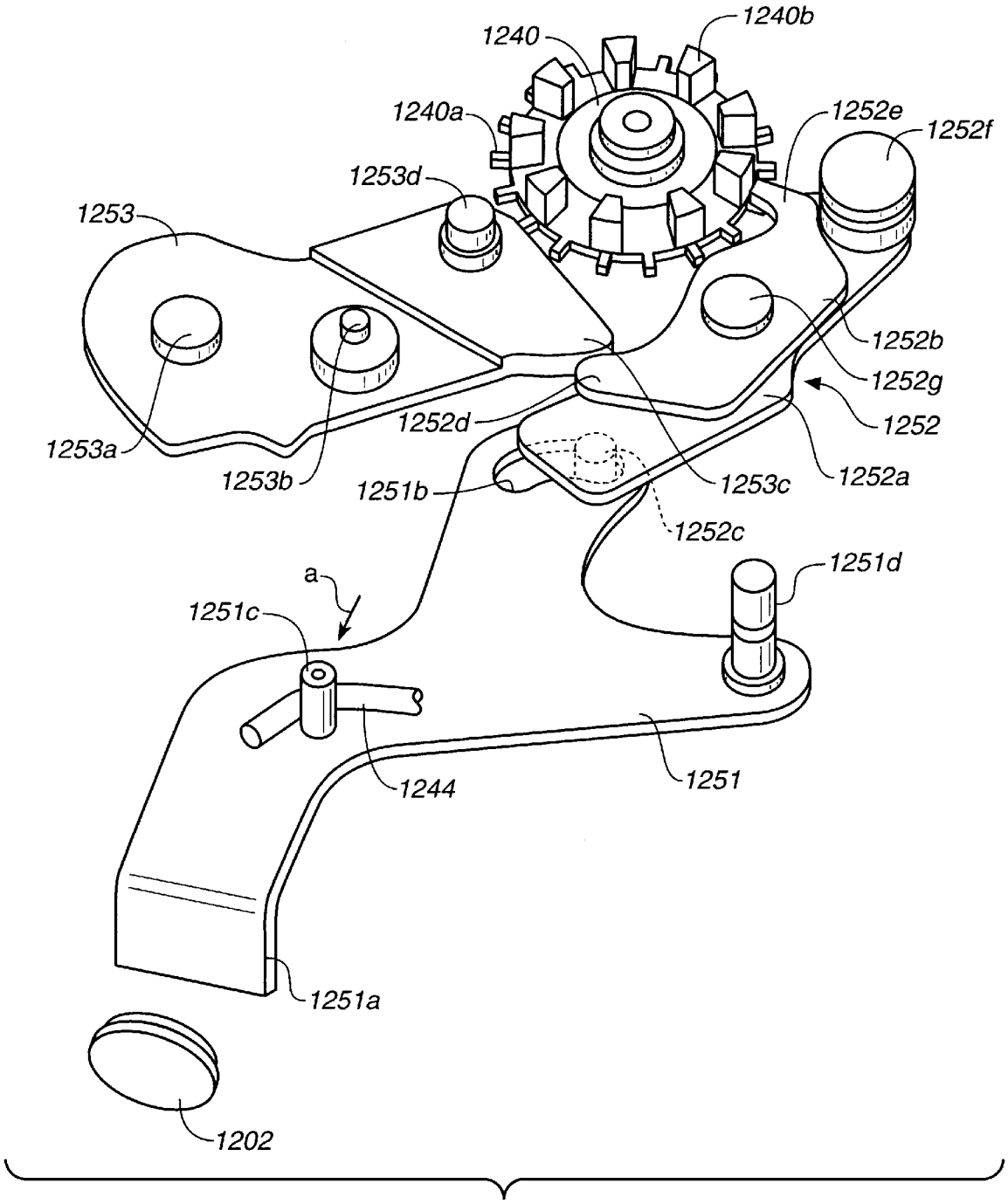
FIG. 15 is a third perspective view showing the operational example of the safety mechanism in the chronograph of FIG. 8.

Even if the pressure portion 1252*d* touches the pressure portion 1253*c* of the intermediate hammer 1253, the pressure portion 1253*c* is not pressed by the pressure portion 1252*d* because the pressure portion 1252*e* of the second hammer operating lever member 1252*b* enters the space between columns 1240*b* of the operating cam 1240. The second hammer operating lever member 1252*b* pivots about the pin 1252*g*, thereby covering its own stroke without pressing the pressure portion 1253*c*. The force exerted onto the reset button 1202 is disconnected by the hammer operating lever 1252 and is not transmitted to the intermediate hammer 1253 to be described later and succeeding stages of the reset operating mechanism, and even if the reset button 1202 is erroneously pressed with the chronograph section 1200 in the start state, the chronograph section 1200 is prevented from being reset. When the chronograph section 1200 is in the stop state on the other hand, the operating lever 1251 is positioned as shown in FIG. 15 so that the pressure portion 1251*a* remains detached from the reset button 1202 and the pin 1251*c* is urged under the elastic force of the operating lever spring 1244 in the direction of an arrow "a" as shown. The pressure portion 1252*e* of the second hammer operating lever member 1252*b* is outside the area of the columns 1240*b* of the operating cam 1240.

Figure 16:
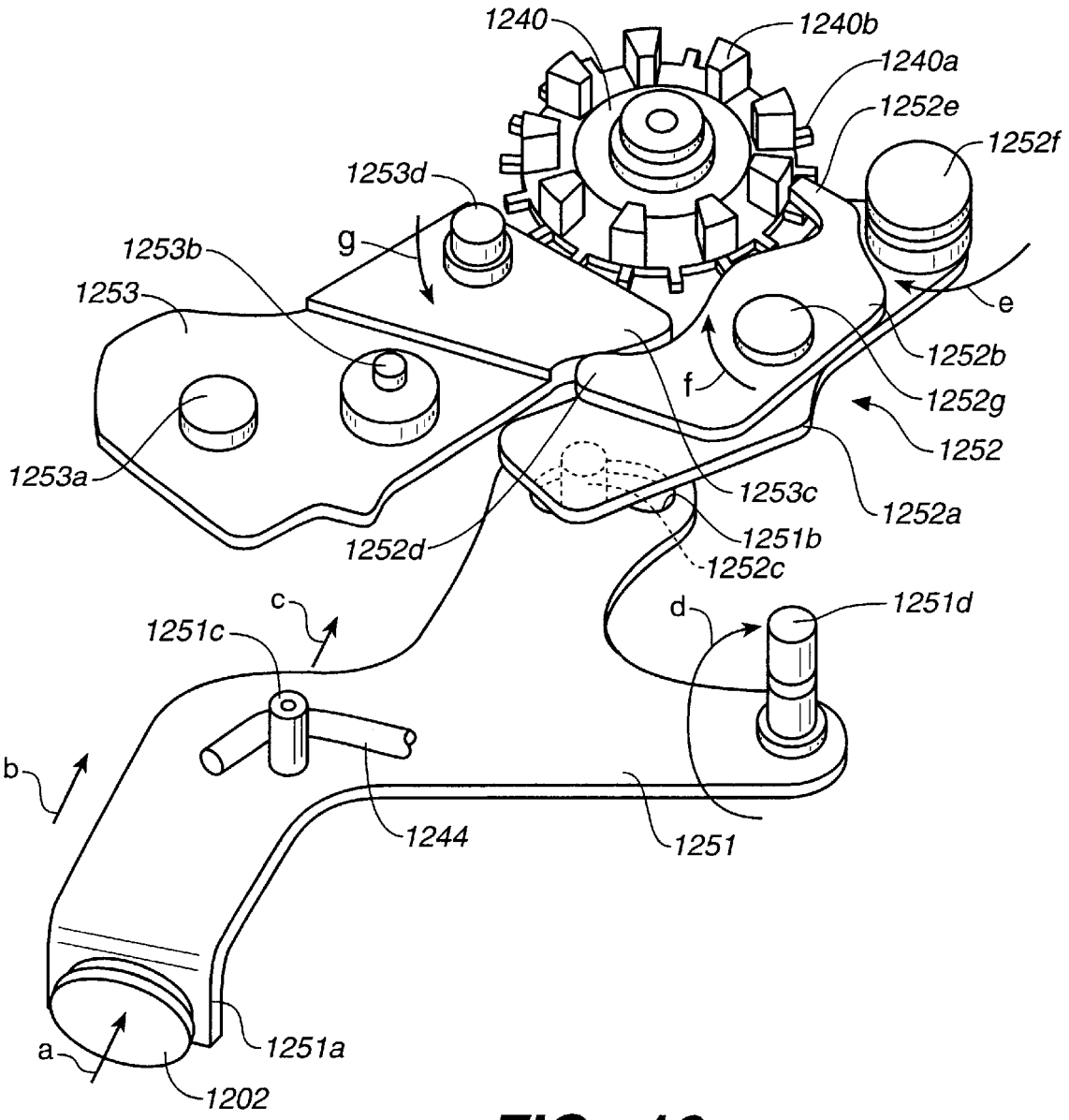
FIG. 16 is a fourth perspective view showing the operational example of the safety mechanism in the chronograph of FIG. 8.

When the reset button 1202 is manually pressed in the direction of an arrow "a" as shown in FIG. 16 in the above state, the reset button 1202 touches and presses the pressure portion 1251*a* of the operating lever 1251 in the direction of an arrow "b" as shown, and the pin 1251*c* presses and elastically deforms the operating lever spring 1244 in the direction of an arrow "c" as shown. The entire operating lever 1251 pivots about the pin 1251*d* in the direction of an arrow d as shown. Along with this pivotal motion, the operating lever 1251 moves the pin 1252*c* of the first hammer operating lever member 1252*a* along the through hole 1251*b*, thereby pivoting the first hammer operating lever member 1252*a* about the pin 1252*f* in the direction of an arrow "e" as shown.

Since the pressure portion 1252*e* of the second hammer operating lever member 1252*b* is then engaged with the side wall of the column 1240*b*, the second hammer operating lever member 1252*b* pivots about the pin 1252*g* in the direction of an arrow "f" as shown. Along with this pivotal motion, the pressure portion 1252*d*of the second hammer operating lever member 1252*b* touches and presses the pressure portion 1253*c* of the intermediate hammer 1253, thereby pivoting the intermediate hammer 1253 about the pin 1253*d* in the direction of an arrow g as shown. The force acting on the reset button 1202 is thus transmitted to the intermediate hammer 1253 and succeeding stages in the reset operating mechanism. The chronograph section 1200 is thus reset by pressing the reset button 1202 when the chronograph section 1200 is in the stop state. When the reset is activated, the contact point of the switch lever B1257 is put into contact with a reset circuit of the circuit board 1704, electrically resetting the chronograph section 1200.

Figure 17:
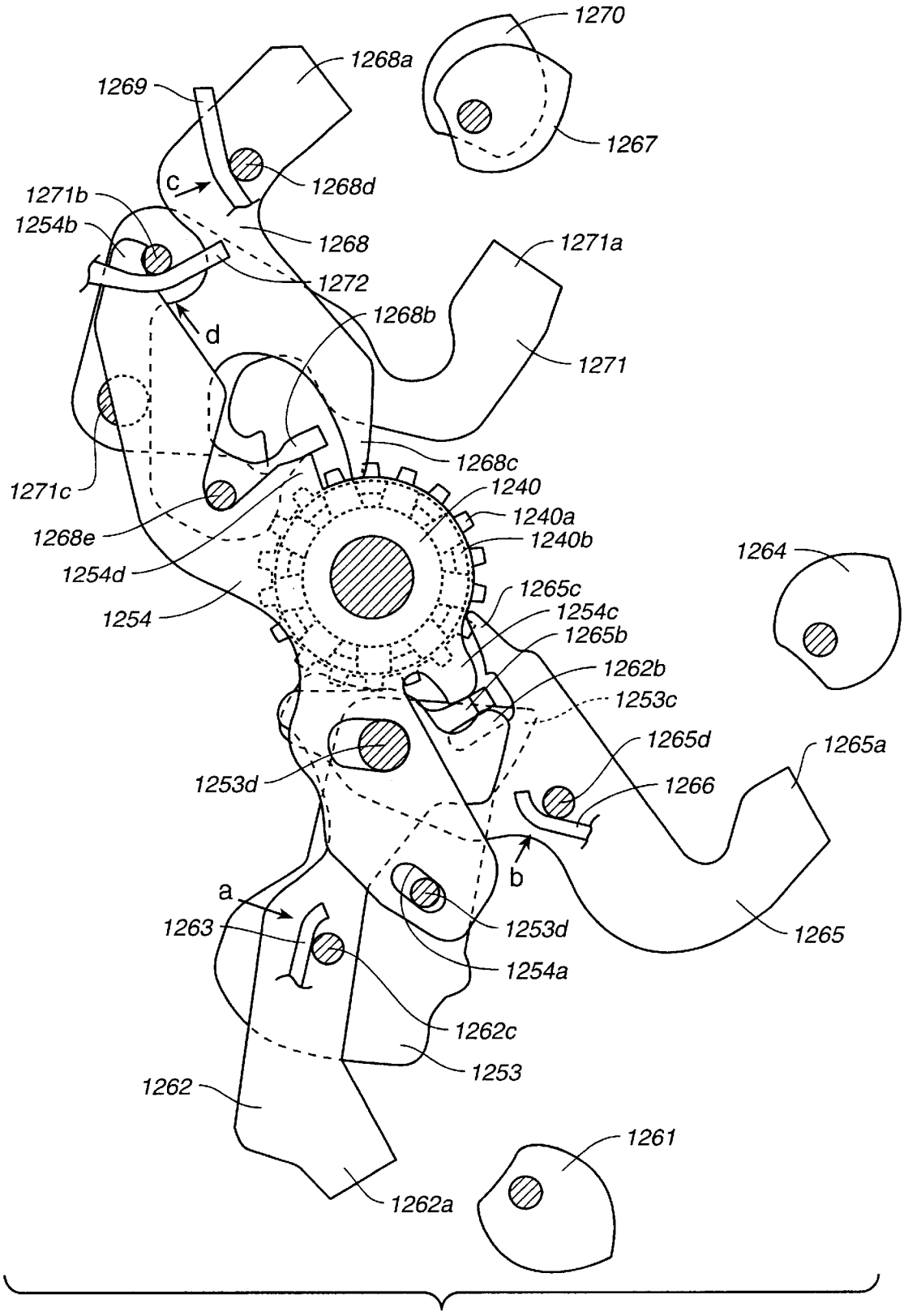
FIG. 17 is a first plan view showing the operational example of a major portion of a reset operating mechanism in the chronograph of FIG. 8.

Referring to FIG. 17, a major portion of the reset operating mechanism of the chronograph section 1200 shown in FIG. 8 is now discussed. The reset operating mechanism hammer driving lever 1254, heart cam A1261, zero reset lever A1262, zero reset lever A spring 1263, heart cam B1264, zero reset lever B1265, zero reset lever B spring 1266, heart cam C1267, zero reset lever C1268, zero reset lever C spring 1269, heart cam D1270, zero reset lever D1271, and zero reset lever D spring 1272.

The hammer driving lever 1254, having a generally I-shape, planar structure, includes an elliptical through hole 1254*a* near one end, a lever D restraining portion 1254*b* on the other hand, and a lever B restraining portion 1254*c* and a lever C restraining portion 1254*d* in the center. The hammer driving lever 1254 is pivotally supported at its center, and constitutes the reset operating mechanism, in which the pin 1253*b* of the intermediate hammer 1253 is received within the through hole 1254*a*.

The heart cams A1261, B1264, C1267, and D1270 are respectively attached to the rotary shafts of the CG 1/10-second wheel 1232, CG second wheel 1223, CG minute wheel 1216, and CG hour wheel 1217.

The zero reset lever A1262 has, on one end, a hammer portion 1262*a* for abutting the heart cam A1261, a rotation setting portion 1262*b* on the other end, and a pin 1262*c* in the center. The zero reset lever A1262 is pivotally supported by the pin 1253*d*, the other end of which is affixed to the movement. The zero reset lever A1262 constitutes the reset operating mechanism, in which one end of the zero reset lever A spring 1263 is anchored at the pin 1262*c*.

The zero reset lever B1265 has, on one end, a hammer portion 1265*a* for abutting the heart cam B1264, a rotation setting portion 1265*b* and a pressure portion 1265*c* on the other end, and a pin 1265*d* in the center. The zero reset lever B1265 is pivotally supported by the pin 1253*d*, the other end of which is affixed to the movement. The zero reset lever B1265 constitutes the reset operating mechanism, in which one end of the zero reset lever B spring 1266 is anchored at the pin 1265*d*.

The zero reset lever C1268 has, on one end, a hammer portion 1268*a* for abutting the heart cam C1267, a rotation setting portion 1268*b* and a pressure portion 1268*c* on the other end, and a pin 1268*d* in the center. The zero reset lever C1268 is pivotally supported at a pin 1268*e*, the other end of which is affixed to the movement. The zero reset lever C1268 constitutes the reset operating mechanism, in which one end of the zero reset lever C spring 1269 is anchored at the pin 1268*d*.

The zero reset lever D1271 has, on one end, a hammer portion 1271*a* for abutting the heart cam D1270, and a pin 1271*b* on the other end. The zero reset lever D1271 is pivotally supported at a pin 1271*c*, the other end of which is affixed to the movement. The zero reset lever D1271 constitutes the reset operating mechanism, in which one end of the zero reset lever D spring 1272 is anchored at the pin 1271*b*.

Figure 18:
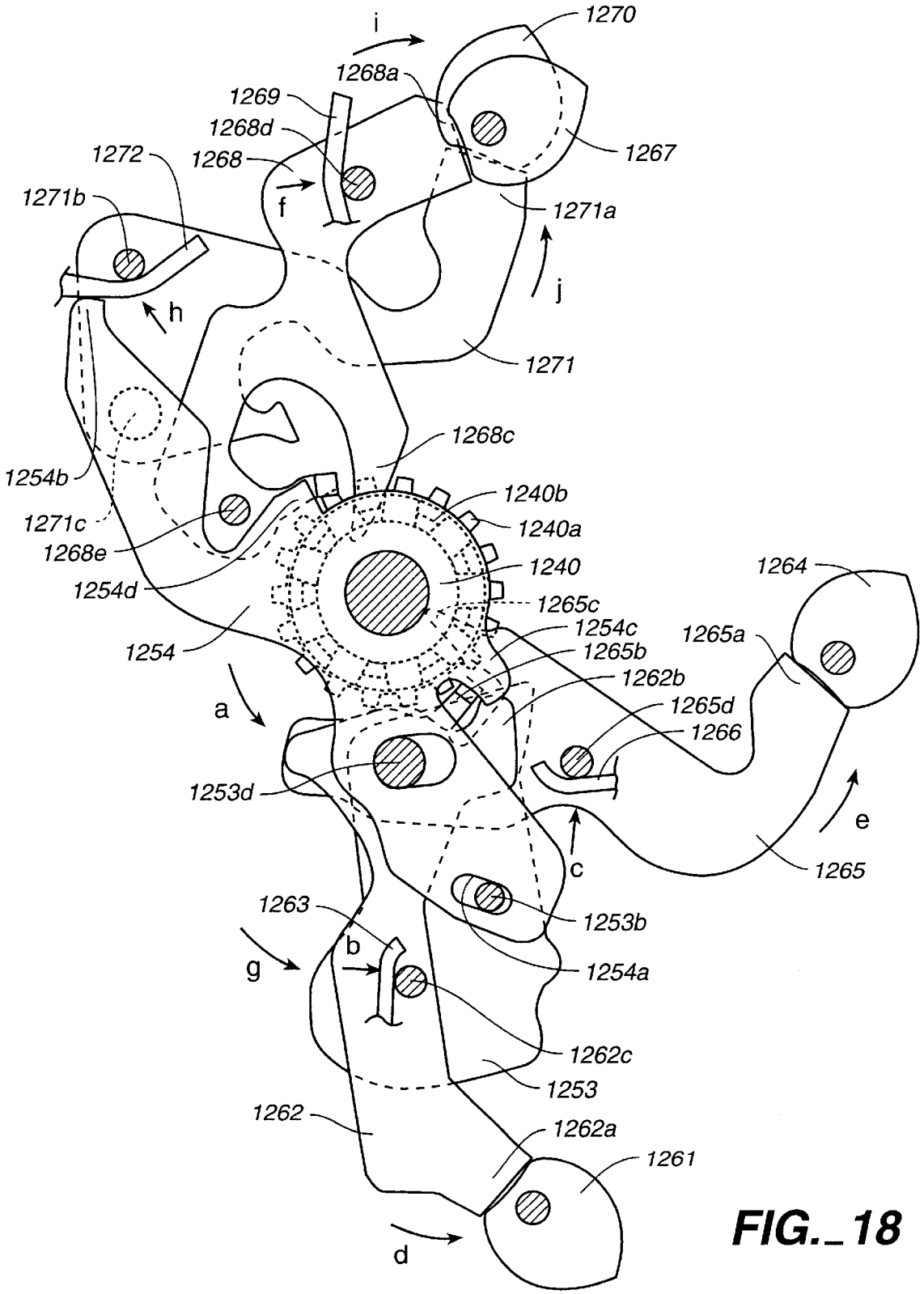
FIG. 18 is a second plan view showing the operational example of the major portion of the reset operating mechanism in the chronograph of FIG. 8.

The operation of the reset operating mechanism is now discussed, referring to FIG. 17 and FIG. 18.

When the chronograph section 1200 is in the stop state, the zero reset lever A1262 is positioned as shown in FIG. 17 so that the rotation setting portion 1262*b* is engaged with the rotation setting portion 1265*b* of the zero reset lever B1265, and the pin 1262*c* is urged under the elastic force of the zero reset lever A spring 1263 in the direction of an arrow a as shown.

The zero reset lever B1265 is positioned so that the rotation setting portion 1265*b* is engaged with the lever B restraining portion 1254*c* of the hammer driving lever 1254, the pressure portion 1265*c* is pressed by the side wall of the column 1240*b* of the operating cam 1240, and the pin 1265*d* is urged under the elastic force of the zero reset lever B spring 1266 in the direction of an arrow b as shown.

The zero reset lever C1268 is positioned so that the rotation setting portion 1268*b* is engaged with the lever C restraining portion 1254*d* of the hammer driving lever 1254, the pressure portion 1268*c* is pressed by the side wall of the column 1240*b* of the operating cam 1240, and the pin 1268*d* is urged under the elastic force of the zero reset lever C spring 1269 in the direction of an arrow c as shown.

The zero reset lever D1271 is positioned so that the pin 1271*b* is engaged with the lever D restraining portion 1254*b* of the hammer driving lever 1254 while being urged under the elastic force of the zero reset lever D spring 1272 in the direction of an arrow "d" as shown.

The respective hammer portions 1262*a*, 1265*a*, 1268*a*, and 1271*a* of the zero reset levers A1262, B1265, C1268, and D1271 are positioned to be apart from the respective heart cams A1261, B1264, C1267, and D1270 by predetermined separations.

When the intermediate hammer 1253 pivots about the pin 1253*d* in the direction of an arrow "g" as shown in FIG. 16 in the above state, the pin 1253*b* of the intermediate hammer 1253 moves within the through hole 1254*a* of the hammer driving lever 1254 while pushing the edge of the through hole 1254*a*, and thereby the hammer driving lever 1254 pivots in the direction of an arrow "a" as shown in FIG. 18.

The rotation setting portion 1265*b* of the zero reset lever B1265 is disengaged from the lever B restraining portion 1254*c* of the hammer driving lever 1254, and the pressure portion 1265*c* of the zero reset lever B1265 is inserted into the space between one column 1240*b* and another column 1240*b* of the operating cam 1240. The pin 1265*d* of the zero reset lever B1265 is urged by the restoring force of the zero reset lever B spring 1266 in the direction of an arrow c as shown. The setting of the rotation setting portion 1262*b* is released, and the pin 1262*c* of the zero reset lever A1262 is urged by the restoring force of the zero reset lever A spring 1263 in the direction of an arrow "b" as shown. The zero reset lever A1262 and the zero reset lever B1265 pivot respectively about the pin 1253*d* in the directions of arrows "d" and "e" as shown, and the hammer portions 1262*a* and 1265*a* respectively hit and rotate the heart cams A1261 and B1264, thereby resetting the intermediate CG 1/10-second wheel 1231 and the CG second wheel 1221 to zero.

At the same time, the rotation setting portion 1268*b* of the zero reset lever C1268 is disengaged from the lever C restraining portion 1254*d* of the hammer driving lever 1254, the pressure portion 1268*c* of the zero reset lever C1268 enters into the space between columns 1240*b* of the operating cam 1240, and the pin 1268*d* of the zero reset lever C1268 is urged under the restoring force of the zero reset lever C spring 1269 in the direction of an arrow "f" as shown. Furthermore, the pin 1271*b* of the zero reset lever D1271 is disengaged from the lever D restraining portion 1254*b* of the hammer driving lever 1254. In this way, the pin 1271*b* of the zero reset lever D1271 is urged under the restoring force of the zero reset lever D spring 1272 in the direction of an arrow h as shown. The zero reset lever C1268 and the zero reset lever D1271 respectively pivot about the pin 1268*e* and pin 1271*c* in the directions of arrows i and j as shown. The hammer portion 1268*a* and hammer portion 1271*a* respectively hit and rotate the heart cams C1267 and D1270, resetting the hour and minute hands 1211 and 1212 to zero.

Through the above series of operational steps, the chronograph section 1200 is reset by pressing the reset button 1202 with the chronograph section 1200 in the stop state.

Figure 19:
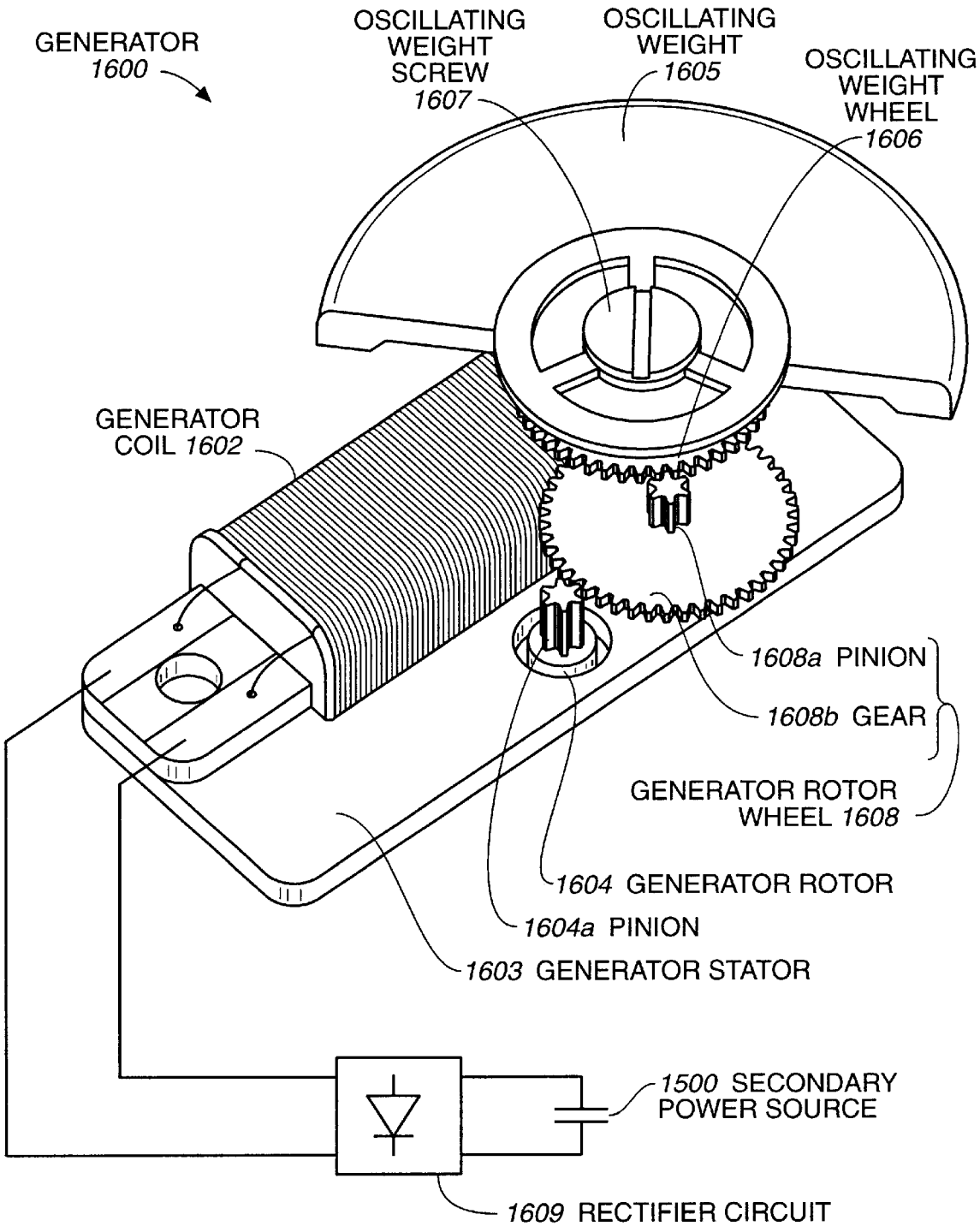
FIG. 19 is a perspective view roughly showing one example of a generator used in the electronic watch of FIG. 1.

FIG. 19 is a perspective view roughly showing a generator used in the electronic watch shown in FIG. 1.

The generator 1600 includes a generator coil 1602 wound around a high-permeability material, a generator stator 1603 constructed of a high-permeability material, a generator rotor 1604 composed of a permanent magnet and a pinion, an oscillating weight 1605 having a one-sided weight.

The oscillating weight 1605 and an oscillating weight wheel 1606 arranged below the oscillating weight 1605 are rotatably supported about a shaft that is rigidly attached to an oscillating weight base. The oscillating weight 1605 and oscillating weight wheel 1606 are prevented from axially coming off with an oscillating weight screw 1607. The oscillating weight wheel 1606 is in mesh with a pinion 1608*a* of a generator rotor wheel 1608, and the pinion 1608*b* of the generator rotor wheel 1608 is in mesh with a pinion 1604*a* of the generator rotor 1604. These train wheels increase an input speed by 30 to 200 times. Such a speed increasing ratio may be optionally selected, depending on the performance of the generator and the specifications of the watch.

When the oscillating weight 1605 oscillates with the motion of the arm of a user, the generator rotor 1604 rotates fast. Since the permanent magnet is rigidly attached to the generator rotor 1604, the direction of a magnetic flux intersecting the generator coil 1602 through the generator stator 1603 changes each time the generator rotor 1604 turns, and an alternating current is generated in the generator coil 1602 by electromagnetic induction. The alternating current is rectified through a rectifier circuit 1609 and charges the secondary battery 1500.

Figure 20:
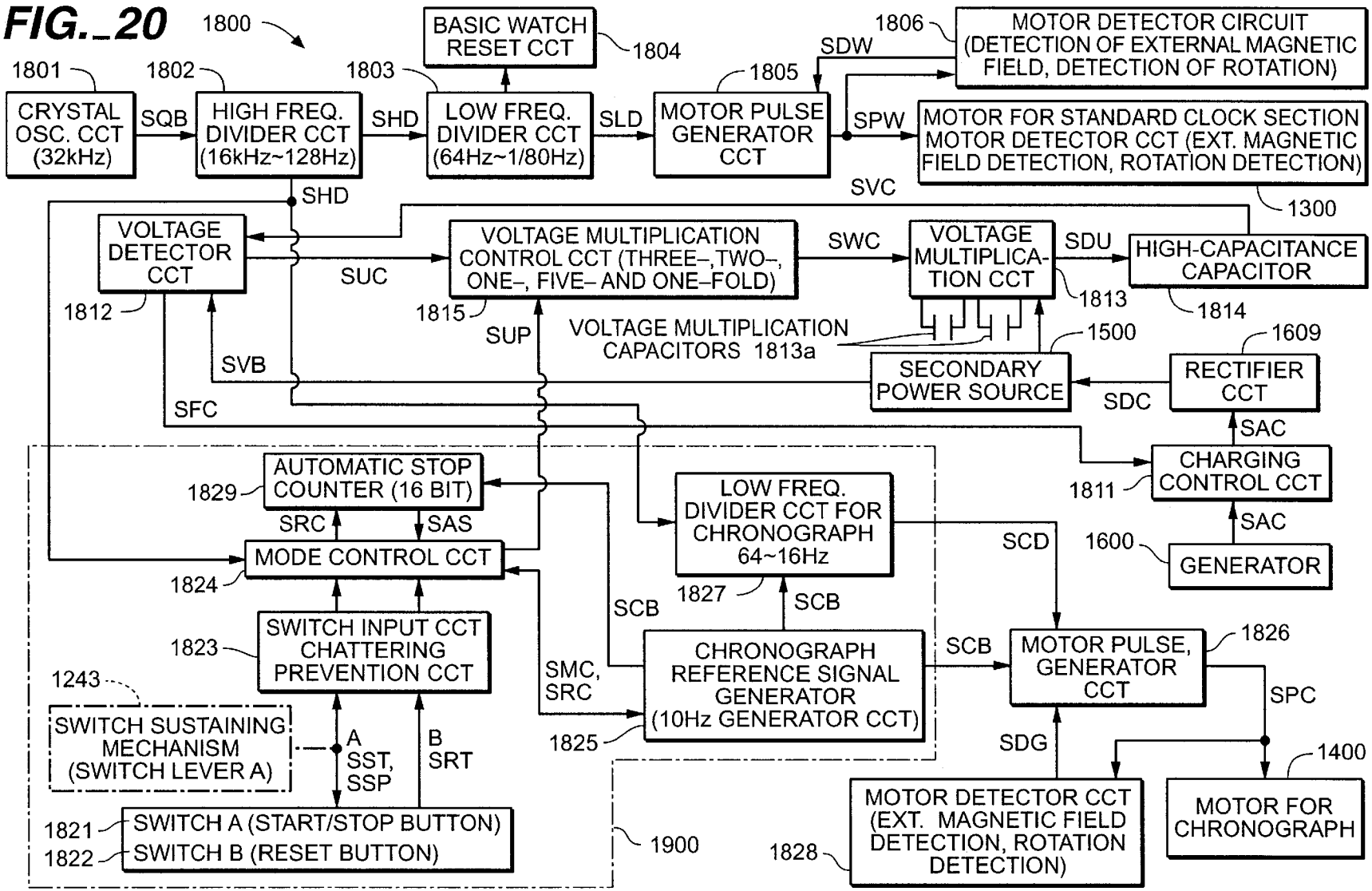
FIG. 20 is a block diagram representation of a control circuit used in the electronic watch of FIG. 1.

FIG. 20 is a block diagram roughly showing the entire system of the electronic watch of FIG. 1 with the mechanical sections removed.

A signal, for example, a signal SQB of an oscillation frequency of 32 kHz, output from a crystal oscillator circuit 1801 including a tuning fork crystal oscillator 1703, is fed to a high-frequency frequency divider 1802, which in turn frequency-divides the signal SQB into a frequency within a range from 16 kHz to 128 Hz. A signal SHD, frequency-divided by the high-frequency frequency divider 1802, is input to a low-frequency frequency divider 1803, which in turn frequency-divides the input signal into a signal within a range of 64 Hz to 1/80 Hz. The oscillation frequency of the low-frequency frequency divider 1803 is resettable by a basic watch reset circuit 1804 connected to the low-frequency frequency divider 1803.

A signal SLD, frequency-divided by the low-frequency frequency divider 1803, is fed to a motor pulse generator circuit 1805 as a timing signal. When the frequency divided SLD signal is made active every second or every 1/10 second, a motor driving pulse and detecting pulse SPW for detecting motor rotation and the like are generated. The motor driving pulse SPW, generated in the motor pulse generator circuit 1805, is fed to the motor 1300 for the standard clock section 1100 to drive it. At a timing different from this pulse SPW, the pulse SPW for detecting the motor rotation and the like is fed to a motor detector circuit 1806, which detects the external magnetic field of the motor 1300 and the rotation of the motor 1300. The external magnetic field signal and rotation signal SDW, detected by the motor detector circuit 1806, is fed back to the motor pulse generator circuit 1805.

An alternating current SAC, generated in the generator 1600, is fed to the rectifier circuit 1609 via a charging control circuit 1811, and is full-wave rectified into a direct current voltage SDC, which then charges the secondary power source 1500. A voltage SVB across both terminals of the secondary power source 1500 is detected by a voltage detector circuit 1812, continuously or as required. Depending on the fully or insufficiently charged state of the secondary battery 1500, the voltage detector circuit 1812 feeds a corresponding charging control command SFC to the charging control circuit 1811. In response to the charging control command SFC, the start and stop of the supply of the alternating current SAC, generated by the generator 1600, to the rectifier circuit 1609 is controlled.

The direct current voltage SDC, charging the secondary power source 1500, is fed to a voltage multiplication circuit 1813 having voltage multiplication capacitors 1813*a*, where the direct current voltage SDC is multiplied at a predetermined multiplication rate. The voltage multiplied direct current voltage SDU is stored in the high-capacitance capacitor 1814.

The voltage multiplication is means to ensure that the motors and circuits reliably operate even if the voltage of the secondary power source 1500 drops the operating voltage of the motors and circuits. In other words, the motors and circuits are together driven by electrical energy stored in the high-capacitance capacitor 1814. If the voltage across the secondary power source 1500 becomes large and approaches 1.3 V, the high-capacitance capacitor 1814 and the secondary power source 1500 are connected in parallel in operation.

The voltage SVC across both terminals of the high-capacitance capacitor 1814 is detected by the voltage detector circuit 1812, continuously or as required, and depending on the electricity remaining in the high-capacitance capacitor 1814, a voltage multiplication command SUC, corresponding to the remaining electricity, is supplied to a voltage multiplication control circuit 1815. The voltage multiplication rate SWC in the voltage multiplication circuit 1813 is controlled in accordance with the voltage multiplication command SUC. The voltage multiplication rate refers to a multiplication rate at which the voltage across the secondary power source 1500 is boosted and generated across the high-capacitance capacitor 1814, specifically, the rate of (voltage across the high-capacitance capacitor 1814)/(voltage across the secondary power source 1500) is controlled at a rate of 3-fold, 2-fold, 1.5-fold, or 1-fold.

A start signal SST, a stop signal SSP, and a reset signal SRT, from a switch A1821 associated with the start/stop button 1201 and a switch B1822 associated with the reset button 1202, are fed to a mode control circuit 1824 for controlling the mode in the chronograph section 1200, through a switch input circuit 1823 for determining whether the start/stop switch 1201 is pressed or a switch input circuit/chattering prevention circuit 1823 for determining whether the reset button 1202 is pressed. The switch A1821 is provided with the switch lever A1243 as a switch sustaining mechanism, and the switch B1822 is provided with the switch lever B1257.

The signal SHD, frequency-divided by the high-frequency frequency divider 1802, is input to the mode control circuit 1824. In response to the start signal SST, the mode control circuit 1824 outputs a start/stop control signal SMC, and a chronograph reference signal SCB, which the chronograph reference signal generator circuit 1825 generates in response to the start/stop control signal SMC, is fed to the motor pulse generator circuit 1826.

The chronograph reference signal SCB, generated in the chronograph reference signal generator circuit 1825, is also fed to the low-frequency frequency divider circuit 1827, and, the signal SHD, frequency-divided by the high-frequency frequency divider 1802, is frequency-divided into a frequency range of 64 Hz to 16 Hz, in synchronization with the chronograph reference signal SCB. The signal SCD, frequency-divided by the low-frequency frequency divider circuit 1827, is input to a motor pulse generator circuit 1826.

The chronograph reference signal SCB and the frequency-divided signal SCD are fed to the motor pulse generator circuit 1826 as timing signals. For example, the frequency-divided signal SCD is made active in accordance with the output timing of 1/10-second or 1 second chronograph reference signal SCB, and based on the frequency-divided signal SCD and the like, the motor driving pulse and the pulse SPC for detecting the motor rotation and the like is generated. The motor driving pulse SPC, generated in the motor pulse generator circuit 1826, is fed to the motor 1400 in the chronograph section 1200 to drive it. At a timing different from that of the driving pulse SPC, the pulse SPC for detecting the motor rotation and the like is fed to a motor detector circuit 1828, which detects the external magnetic field of the motor 1400 and the rotation of the motor 1400. The external magnetic field signal and rotation signal SDG, detected by the motor detector circuit 1828, are fed back to the motor pulse generator circuit 1826.

The chronograph reference signal SCB, generated by the chronograph reference signal generator circuit 1825, is input to a 16-bit automatic stop counter 1829 for counting. When the count at the counter 1829 reaches a predetermined value, namely, a measurement time limit, an automatic stop counter 1829 outputs an automatic stop signal SAS to the mode control circuit 1824. The reset signal SRC is then input to the chronograph reference signal generator circuit 1825, and the chronograph reference signal generator circuit 1825 is stopped and reset.

When the stop signal SSP is input to the mode control circuit 1824, the output of the start/stop control signal SMC stops, and the generation of the chronograph reference signal SCB stops. The driving of the motor 1400 in the chronograph section 1200 is thus stopped. The reset signal SRT, which is input to the mode control circuit 1824 subsequent to the stop of the generation of the chronograph reference signal SCB, namely, subsequent to the stop of the generation of the start/stop control signal SMC, is input to the chronograph reference signal generator circuit 1825 and the automatic stop counter 1829, as a reset control signal SRC. The chronograph reference signal generator circuit 1825 and the automatic stop counter 1829 are thus reset, while each chronograph hand is also reset (to zero) in the chronograph section 1200.

The present invention is not limited to the above embodiment, and a variety of modifications is possible without departing from the scope of the claims.

In the above embodiment, two motors, one motor 1300 for driving the standard clock section 1100 and the other motor 1400 for driving the chronograph section 1200, are independently employed. Two or more motors may be employed to drive the chronograph. For example, two motors may be employed: one motor for the minutes and hours and the other motor for the seconds, the tenths of the second, and the hundredths of the second.

The electronic watch having an analog indicator chronograph function, as the time measurement device, has been discussed. The present invention is not limited, and the present invention is applied to a multi-function time measurement device having an analog indicator.

In accordance with the present invention, as discussed above, the mechanical zero reset mechanism for the chronograph permits an instantaneous zero resetting. Time measurement is performed without delay. Since a single motor is employed for the display of the chronograph, space dedicated to it is minimized. The power consumption is reduced, and the time measurement device is operated from the power generated by the generator only. This arrangement frees the user from a battery replacement operation, reduces the cost of the device, and eliminates the need for other operations involved in the battery replacement.

Industrial Applicability

The present invention is particularly useful for use in a multi-function time measurement device having watch hands.

What is claimed is:

1. A time measurement device comprising:

a first motor for driving a standard time indicator, a second motor for driving a chronograph, a generator which generates a first voltage signal, a secondary power source charged by the first voltage signal, a voltage multiplication circuit which multiplies the first voltage signal by a determined multiplication rate to generate a second voltage signal, a primary power source that stores the voltage of the second voltage signal and outputs a third voltage signal, a voltage multiplication control circuit which determines the multiplication rate by which the first voltage signal is multiplied based on the third voltage signal, and a zero reset mechanism for mechanically resetting the chronograph to zero.

2. A time measurement device according to claim 1, wherein the zero reset mechanism comprises a zero reset lever for resetting the chronograph to zero and an operating cam, arranged approximately in the center of the body of the device, for operating the zero reset lever.

3. A time measurement device according to claim 1, wherein the chronograph includes an indicator having at least two units of time.

4. A time measurement device according to claim 3, wherein the indicator is driven by the second motor.

5. A time measurement device according to claim 3, wherein the indicator includes train wheels.

6. A time measurement device according to claim 1, wherein the generator comprises a generator rotor and a generator coil.

7. A time measurement device according to claim 6, wherein the generator rotor is rotated by an oscillating weight.

8. A wristwatch comprising the time measurement device of claim 1.

9. A time measurement device according to claim 1, wherein the first voltage signal is generated by the generator as an alternating current signal and is rectified into a direct current signal before being used to charge the secondary power source.

10. A time measurement device according to claim 1, further comprising:

a charging control circuit in communication with the generator and the secondary power source; and a voltage detector circuit which detects a fourth voltage signal generated by the secondary power source, and based on the charged state of the secondary power source, outputs a charging control command signal to the charging control circuit to control the generation of the first voltage signal by the generator.

11. A time measurement device comprising:

a first motor for driving a standard time indicator, a second motor for driving a chronograph, a generator, and a zero reset mechanism for mechanically resetting the chronograph to zero, the zero reset mechanism comprising a zero reset lever for resetting the chronograph to zero and an operating cam, arranged approximately in the center of a body, for operating the zero reset lever.

12. A time measurement device comprising:

a first motor for driving a standard time indicator, a second motor for driving a chronograph, and a zero reset mechanism for mechanically resetting the chronograph to zero, the zero reset mechanism comprising a zero reset lever for resetting the chronograph to zero and an operating cam, arranged approximately in the center of a body, for operating the zero reset lever.

* * * * *

UNITED STATES PATENT AND TRADEMARK OFFICE

CERTIFICATE OF CORRECTION

PATENT NO. : 6,466,518 B1
DATED : October 15, 2002
INVENTOR(S) : Hidehiro Akahane et al.

It is certified that error appears in the above-identified patent and that said Letters Patent is hereby corrected as shown below:

Title page,
Item [86], change § 371 (c)(1), (2), (4) Date: "Feb. 28, 2000" to -- Feb. 24, 2000 --.

Signed and Sealed this

Twentieth Day of May, 2003

JAMES E. ROGAN
*Director of the United States Patent and Trademark Office*